United States Patent [19]

Sugita et al.

[11] Patent Number: 4,814,262

[45] Date of Patent: Mar. 21, 1989

[54] SILVER HALIDE PHOTOGRAPHIC LIGHT-SENSITIVE MATERIAL TO PROVIDE DYE-IMAGE WITH IMPROVED COLOR-FASTNESS TO LIGHT

[75] Inventors: Shuichi Sugita; Shinji Yoshimoto; Naoko Shimada; Satoshi Nakagawa; Yutaka Kaneko, all of Hino; Toyoki Nishijima, Odawara, all of Japan

[73] Assignee: Megumi Ide, Tokyo, Japan

[21] Appl. No.: 107,270

[22] Filed: Oct. 9, 1987

[30] Foreign Application Priority Data

| | | | |
|---|---|---|---|
| Oct. 10, 1986 | [JP] | Japan | 61-240228 |
| Oct. 11, 1986 | [JP] | Japan | 61-241743 |
| Oct. 27, 1986 | [JP] | Japan | 61-314147 |

[51] Int. Cl.[4] ..... G03C 7/26; G03C 7/38; G03C 1/34

[52] U.S. Cl. ..... 430/551; 430/372; 430/558; 430/613

[58] Field of Search ..... 430/551, 558 R, 372, 430/613

[56] References Cited

U.S. PATENT DOCUMENTS

| | | | |
|---|---|---|---|
| 3,336,135 | 8/1967 | Terashima et al. | 430/551 |
| 3,637,393 | 1/1972 | Sakamoto et al. | 430/551 |
| 4,247,628 | 1/1981 | Uchida et al. | 430/551 |
| 4,483,918 | 11/1984 | Sakai et al. | 430/551 |
| 4,622,287 | 11/1986 | Umemoto et al. | 430/551 |
| 4,639,415 | 1/1987 | Kaneko et al. | 430/551 |
| 4,666,826 | 5/1987 | Takada et al. | 430/551 |

*Primary Examiner*—Richard L. Schilling
*Attorney, Agent, or Firm*—Jordan B. Bierman

[57] ABSTRACT

A silver halide photographic light-sensitive material improved in light-fastness of dye images and in prevention of yellow-stain formation in a non-colored area after processing. The photographic material comprises a support having thereon photographic structural layers including at least one silver halide emulsion layer. At least one of the photographic component layers contains a compound represented by the following Formula [I]:

Formula [I]

A magenta coupler represented by the following formula [M-I] is preferably used with the above compound.

Formula [M-I]

11 Claims, 1 Drawing Sheet

SILVER HALIDE PHOTOGRAPHIC LIGHT-SENSITIVE MATERIAL TO PROVIDE DYE-IMAGE WITH IMPROVED COLOR-FASTNESS TO LIGHT

FIELD OF THE INVENTION

The present invention relates to a silver halide photographic light-sensitive material, wherein a dye-image obtained through photographic processing hardly fade due to light and non-colored areas hardly discolor due to light.

BACKGROUND OF THE INVENTION

With a silver halide photographic light-sensitive material, a dye-image derived from a coupler is required not to discolor or fade even if exposed to light for a prolonged period or stored under a high temperature and humidity.

It is known, however, that such dye-images do not yet have satisfactory color fastness to mainly ultraviolet and visible rays, and that they readily discolor or fade if subjected to these active rays. Conventional measures taken to eliminate this disadvantage include a selective use of couplers less likely to discolor, a use of ultraviolet absorbents to protect dye-images from ultraviolet rays, a use of anti-fading agents to prevent color fading due to light, and introduction of a group into couplers for fastness to light.

However, there are limits, for example, to the effect of ultraviolet absorbent; relatively large quantities of ultraviolet absorbents are required to provide satisfactory levels of light-fastness of dye-images, as a result, dye-images are often stained due to the coloring of absorbents. Also, ultraviolet absorbents never prevent visible rays from discoloring dye-images. Some methods are known to use or dye-image anti-fading agents which have phenolic hydroxy/groups or groups being capable of hydrolyzing to produce phenolic hydroxyl groups. The use of phenols and bisphenols is proposed in Japanses Patent Examined Publication No. 31256/1973, No. 31625/1973, No. 30462/1976, Japanese Patent Publication Open to Public Inspection (hereinafter refered to as Japanese Patent O.P.I. Publication) No. 134326/1974, and No. 134327/1974; the use of pyrogallols, gallic acids and esters thereof in U.S. Pat. No. 3,069,262; the use of α-tocopherols and acyl derivatives thereof in U.S. Pat. No. 2,360,290 and U.S. Pat. No. 4,015,990; the use of hydroquinone derivertives in Japanese Patent Examined Publication No. 27534/1977, Japanese Patent O.P.I. Publication No. 14751/1977, and U.S. Pat. No. 2,735,765; the use of 6-hydroxychromans in U.S. Pat. No. 3,432,300 and U.S. Pat. No. 3,574,627; the use of 5-hydroxycoumarin derivertives in U.S. Patent; the use of 6,6'-dihydroxy-2,2'bisspirochromans in Japanese Patent Examined Publication No. 20977/1974. Also, a certain type of p-aminophenol derivertive is mentioned in Japanese Patent O.P.I. Publication No. 6321/1980. Some of these compounds do prevent color-fading or discoloring, but only to a low degree. Some of them turn hues into thereof lower frequencies, generate yellow-stain, and degrade dye forming of couplers.

SUMMARY OF THE INVENTION

It is a general object of the present invention to provide a silver halide photographic material which contains a dye-image stabilizer haviing a superior anti-fading effect and a smaller possibility to change hues, generate yellow-stain, and degrade dye forming of couplers.

The above object of the invention is achieved by a silver halide photographic light-sensitive material comprising a support having thereon photographic structural layers including at least one silver halide emulsion layer, wherein at least one of sais photographiic component layers contains a compound represented by the following general formula [I]:

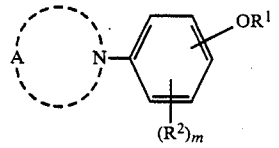

General Formula [I]

wherein $R^1$ represents an alkyl group, a cycloalkyl group, an alkenyl group, an aryl group, a heterocyclic group, an acyl group, a bridged hydrocarbon group, an alkylsulfonyl group or an arylsulfonyl group each allowed to have a substituent; $R^2$ represents a group capable of bonding with benzene ring as a substituent and is allowed to form a ring by bonding to —$OR^1$; m represents in integer of 0 to 4, provided that, when m is 2 or more, $R^2$s may be the same with or the different from each other and are allowed to form a ring by bonding to each other: A represents a group of nonmetallic atoms necessary to form a five to eight membered heterocyclic ring with nitrogen atom.

DETAILED DESCRIPTION OF THE INVENTION

Figure 1:
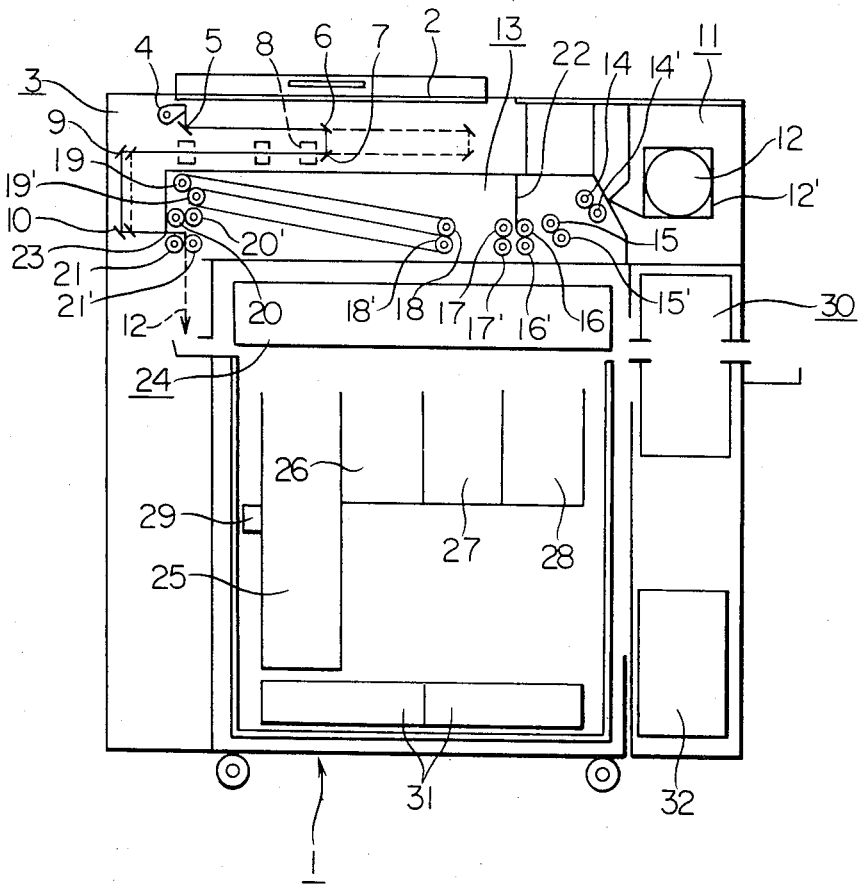
FIG. 1 shows a sectional view of an image forming apparatus that can use a light-sensitive material according to the invention.

Compounds represented by the general formuls [I] are explained below.

A straight-chained or branched alkyl group having 1 to 24 carbon atoms such as a methyl group, an ethyl group, an isopropyl group, a t-butyl group, a 2-ethylhexyl group, a dodecyl group, a t-octyl group, and a benzyl group are preferred as the alkyl group represented by $R^1$ of the general formula [I].

A cycloalkyl group having 5 to 24 carbon atoms such as a cyclopentyl group and a cyclohexyl are preferred as the cycloalkyl group represented by $R^1$.

An alkenyl group having 3 to 24 carbon atoms such as an alkyl group and a 2,4-pentadienyl group are preferred as the alkenyl group represented by $R^1$.

The aryl groups represented by $R^1$ include a phenyl group and a naphthly group.

The heterocyclic groups reprented by $R^1$ include a pyridyl group, an imidazolyl gorup, and a thiazolyl group.

The acyl groups represented by $R^1$ include an acetyl group and a benzoyl group.

The bridged hydrocarbon groups represented by $R^1$ include a bicyclo[2,2,1]heptyl group.

The alkylsulfonyl groups represented by $R^1$ include a dodecylsulfonyl group and a hexadecylsulfonyl group, and the arylsulfonyl groups include a phenylsulfonyl group.

Some of these groups represented by $R^1$ have substituents. For example, substituents the alkyl group may have include a hydroxy group, an alkoxy group, an aryl group, an acylamino group, a sulfonamido group, an aryloxy group, an alkylthio group, a carbamoyl group, a sulfamoyl group, an alkylsulfonyl group, a nitro group, a cyano group, an arylsulfonyl group, a halogen atom, a carboxyl group, an amino group, an arylamino group, an alkylamino group, an alkoxycarbonyl group, an acyl group, and an acyloxy group. Substituents which the groups represented by $R^1$ may have, other than the alkyl group, include an alkyl group as well as the above substituents.

An alkyl group is favorable for $R^1$.

Typical substituents, which can be bonded to a benzen ring represented by $R^2$, include a halogen atom, an alkyl group, an aryl group, an alkoxy group, an aryloxy group, an alkylthio group, an arylthio group, an acyl group, an acylamino group, a sulfonamido group (such as an alkylsulfonamido group, an arylsulfonamido group), an alkoxycarbonyl group, a carbamoyl group (such as an alkylcarbamoyl group, an arylcarbamoyl group), an ureido group (an alkylureido group, an arylureido group), a sulfamoyl group (such as an alkylsulfamoyl group, an arylsulfamoyl group), an amino group (or a substituted amino group), a sulfonyl group, a nitro group, a cyano group, and a carboxyl group. A halogen atom, an alkyl group, an alkylthio group, an acylamino group, and a sulfonamido group are favorable for $R^2$. The groups represented by $R^2$ may have a substituent.

m represents an integer from 0 to 4. An integer between 0 and 2 is desirable. When n is more than 2, substituents represented by $R^2$ may be the same or different, and may form a ring by mutual bonding. $R^2$ may form a ring together with $—OR^1$.

5- or 8-membered rings, which can be formed with A, include a pyrrolidine ring, a piperidine ring, a piperazine ring, a morpholine ring, and a pyridine ring. These rings may have a substituent whose examples are the same as the previously mentioned substituents which a group represented by $R^1$ may have.

$—OR^1$ can take any position on

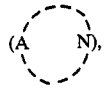

but should preferably take the para-position.

Typical compounds expressed by the general formula [I] are shown below. However, the scope of the invention is not limited only to these examples.

Example compounds (1)

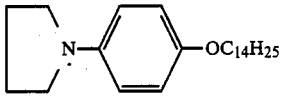

(2)

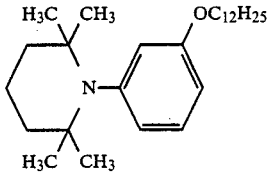

(3)

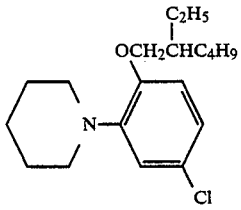

(4)

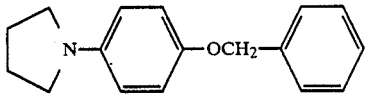

(5)

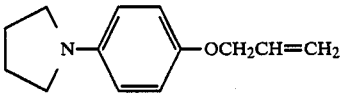

(6)

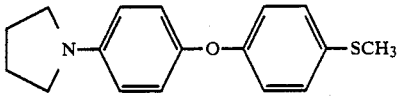

(7)

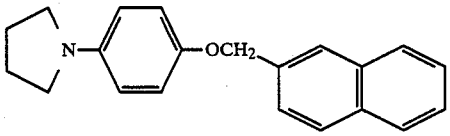

(8)

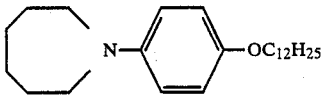

(9)

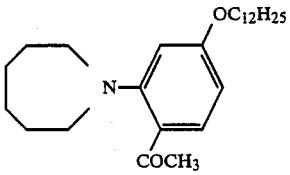

(10)

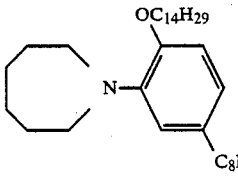

(11)

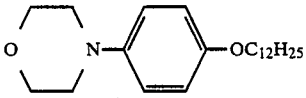

(12)

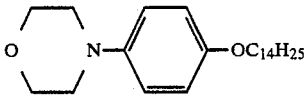

-continued
Example compounds
(13)
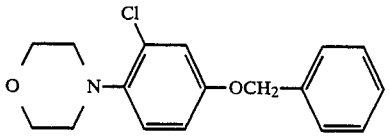
(14)
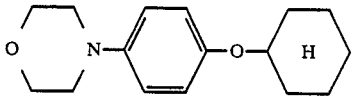
(15)
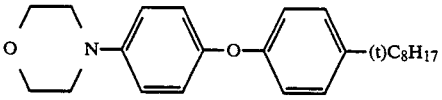
(16)
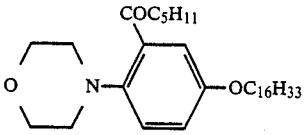
(17)
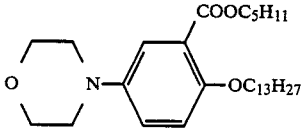
(18)
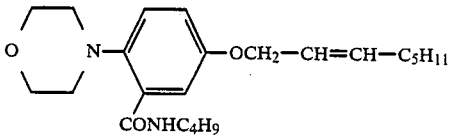
(19)
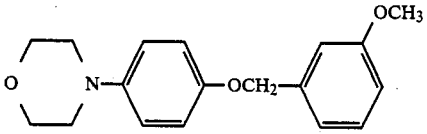
(20)
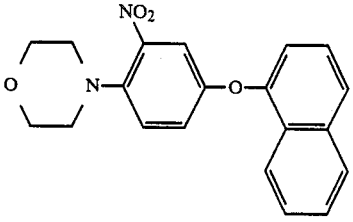
(21)
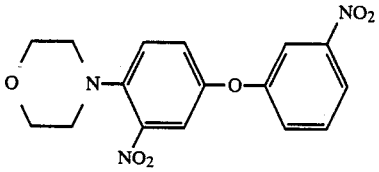
(22)
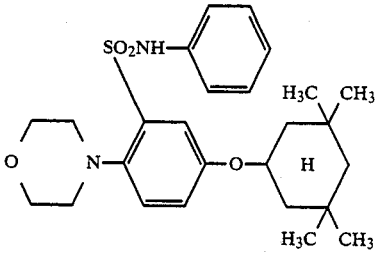
(23)
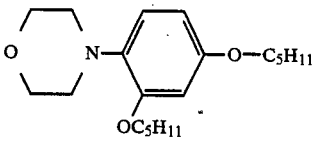
(24)
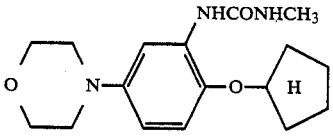
(25)
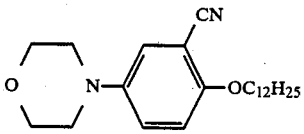
(26)
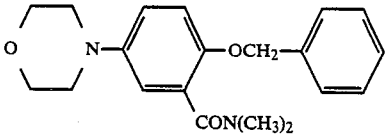
(27)
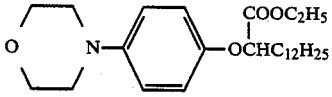
(28)
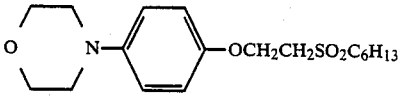
(29)
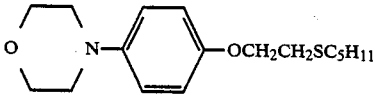
(30)
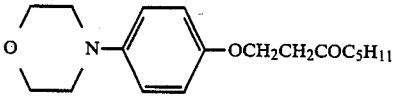
(31)
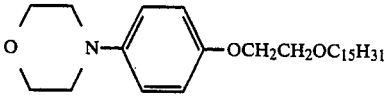
(32)
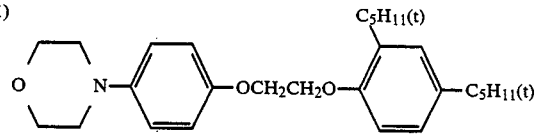

-continued
Example compounds
(33)
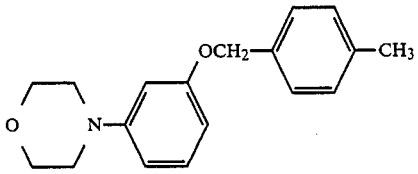
(34)
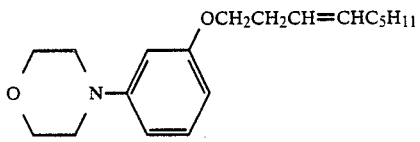
(35)
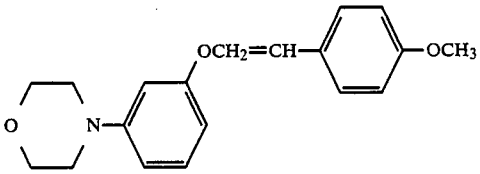
(36)
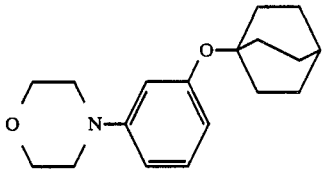
(37)
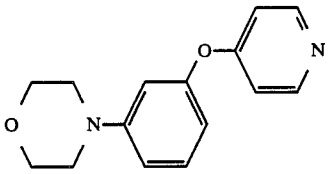
(38)
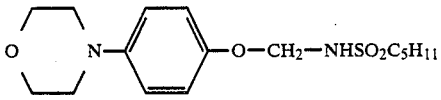
(39)
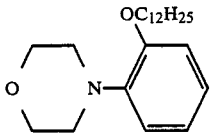
(40)
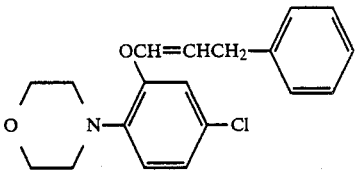
(41)
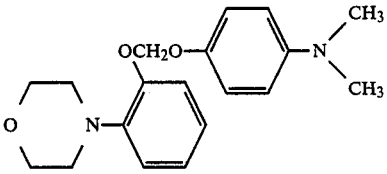
(42)
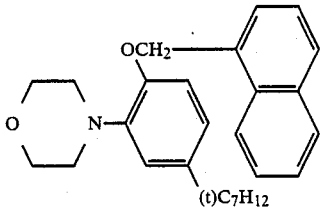
(43)
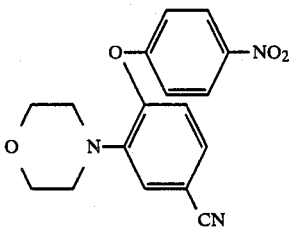
(44)
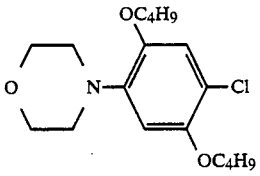
(45)
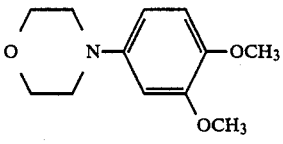
(46)
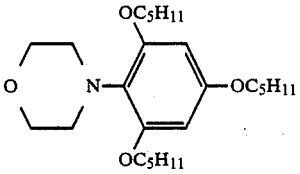
(47)
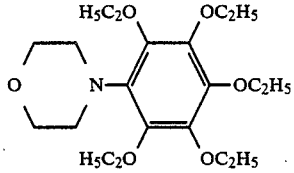
(48)
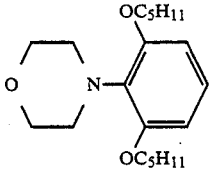

-continued
Example compounds
(49)
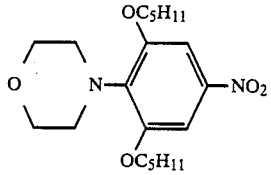
(50)
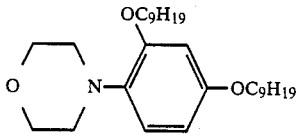
(51)
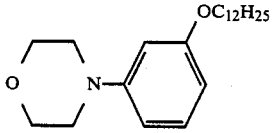
(52)
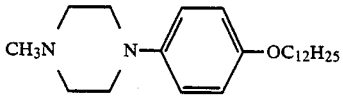
(53)
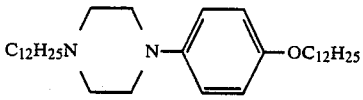
(54)
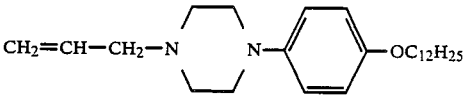
(55)
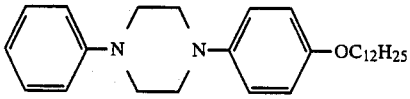
(56)
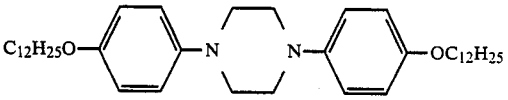
(57)
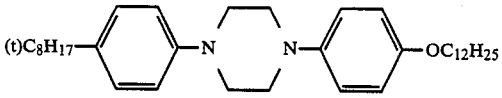
(58)
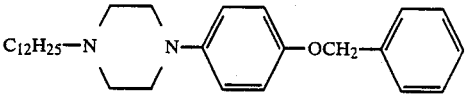
(59)
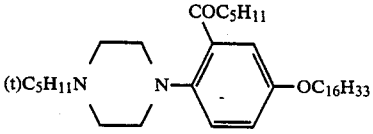
(60)
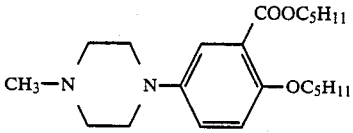
(61)
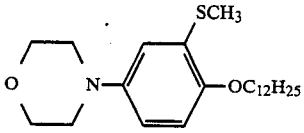
(62)
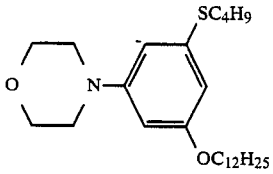
(63)
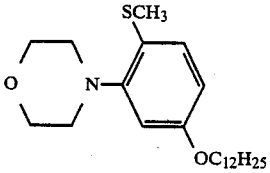
(64)
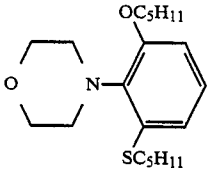
(65)
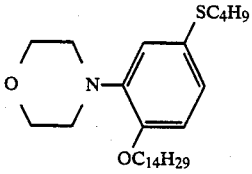
(66)
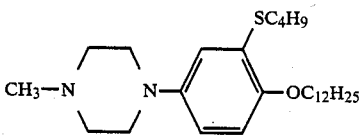
(67)
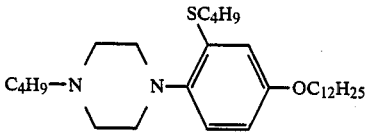
(68)
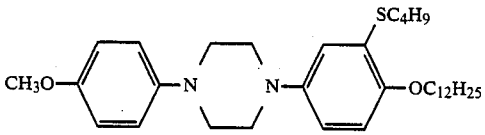

-continued
Example compounds
(69)
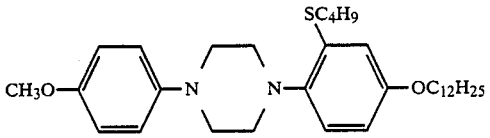
(70)
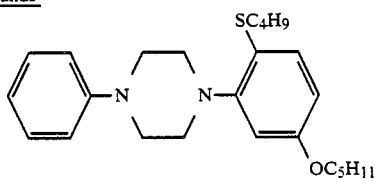
(71)
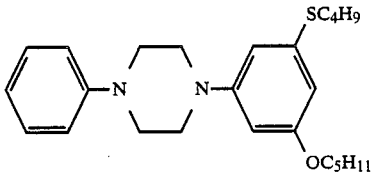
(72)
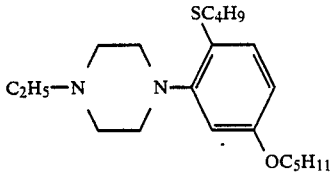
(73)
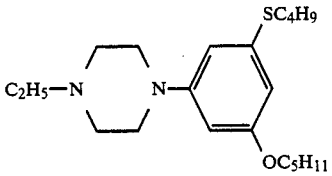
(74)
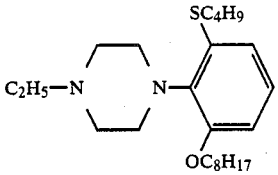
(75)
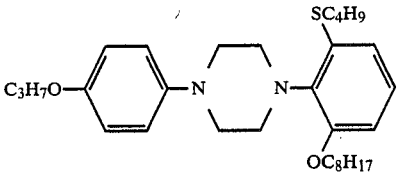
(76)
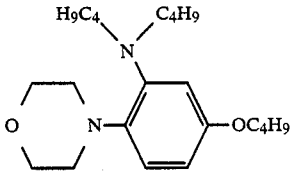
(77)
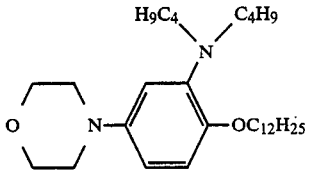
(78)
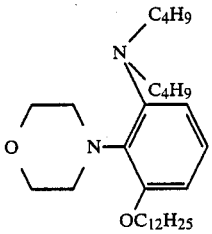
(79)
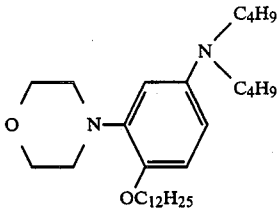
(80)
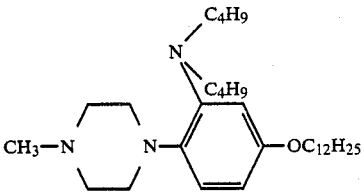
(81)
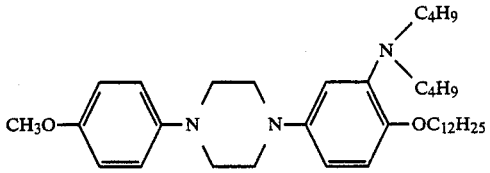
(82)
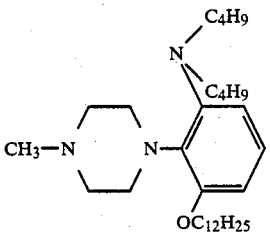
(83)
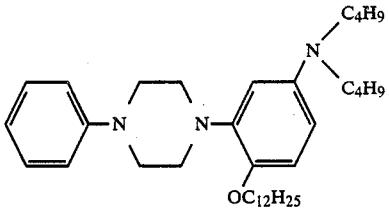
(84)
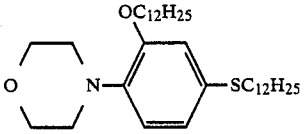

-continued
Example compounds
(85)
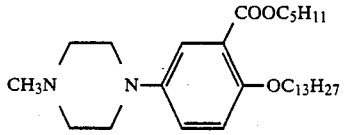
(86)
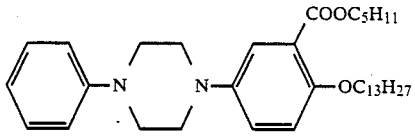
(87)
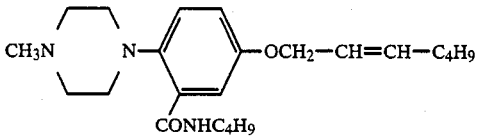
(88)
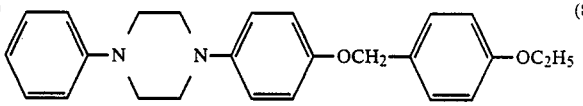
(89)
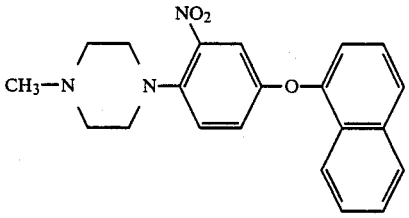
(90)
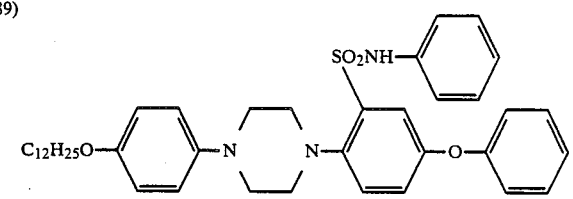
(91)
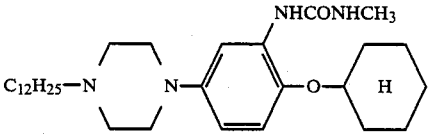
(92)
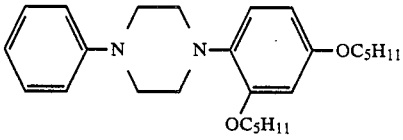
(93)
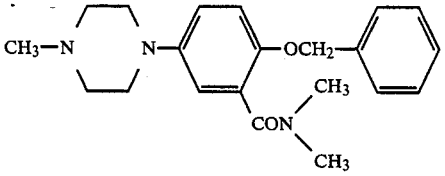
(94)
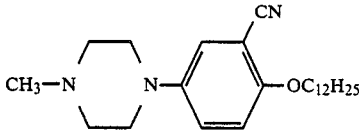
(95)
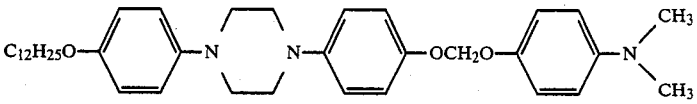
(96)
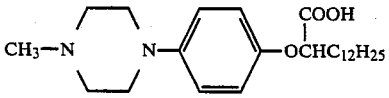
(97)
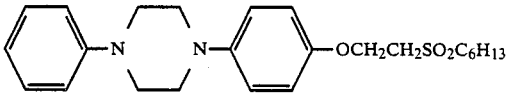
(98)
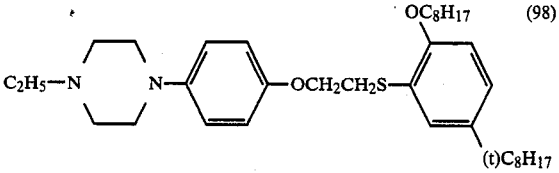
(99)
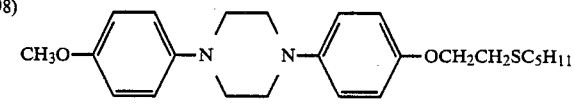
(100)
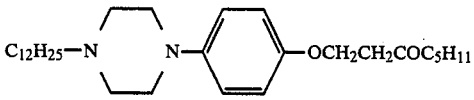
(101)
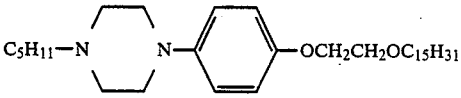
(102)
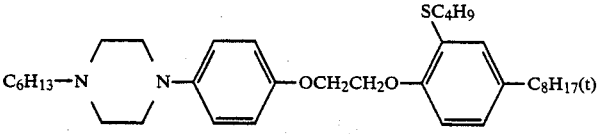

-continued
Example compounds
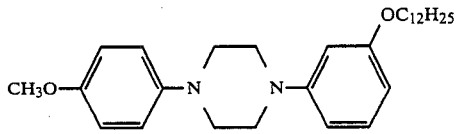
(103)
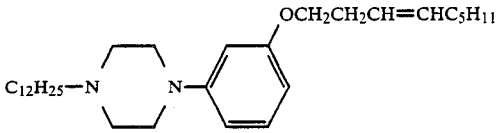
(104)
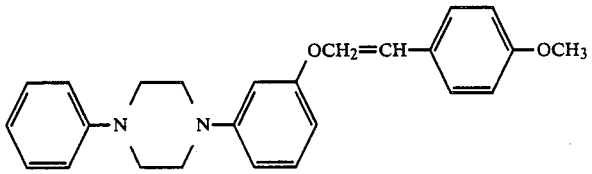
(105)
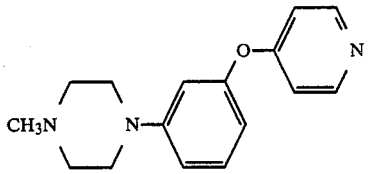
(106)
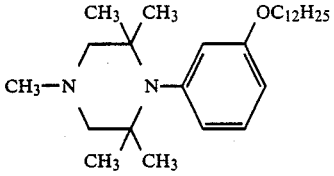
(107)
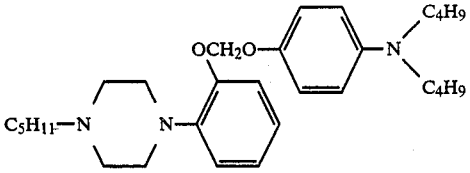
(108)
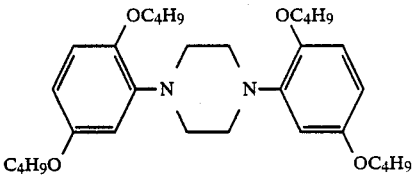
(109)
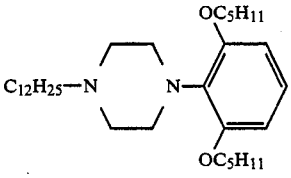
(110)
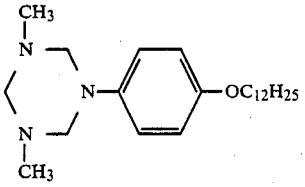
(111)
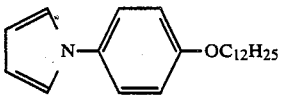
(112)
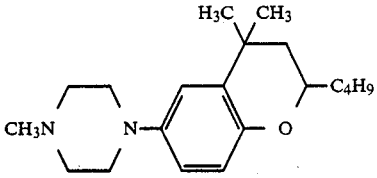
(113)
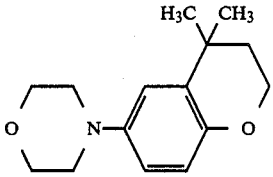
(114)
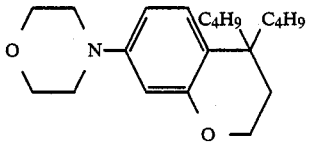
(115)
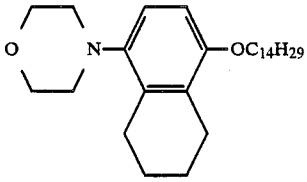
(116)
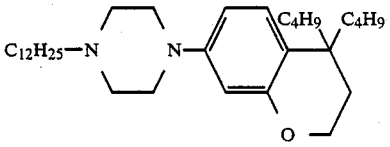
(117)

-continued
Example compounds
(118)
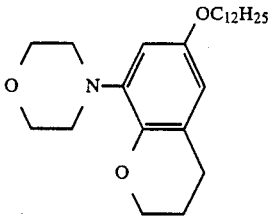
(119)
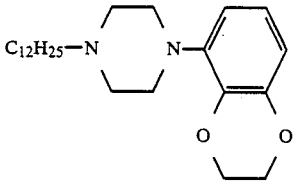
(120)
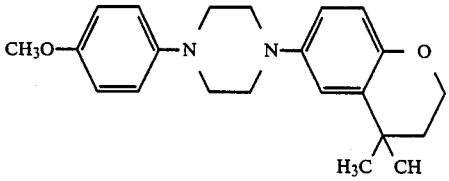
(121)
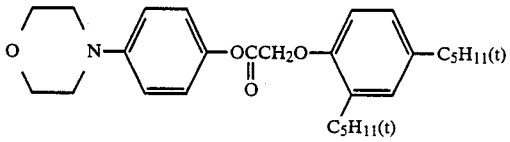
(122)
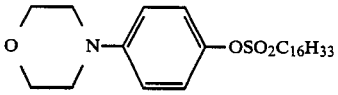
(123)
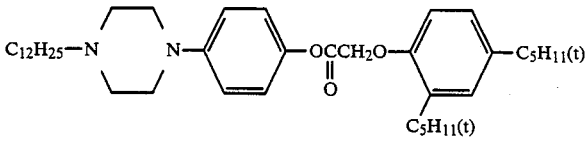
(124)
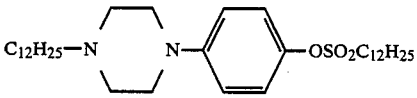
(125)
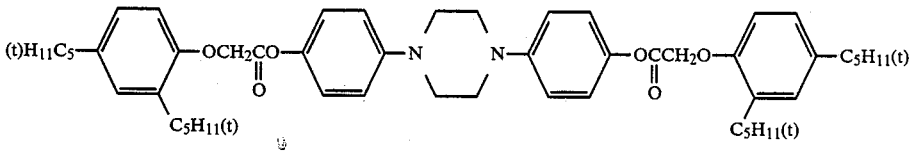
(126)
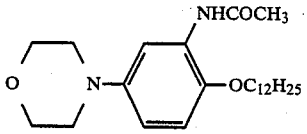
(127)
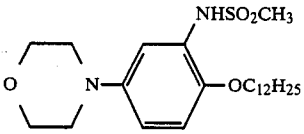
(128)
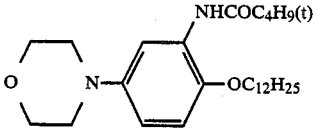
(129)
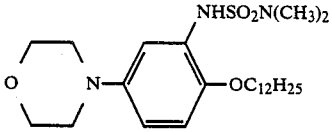
(130)
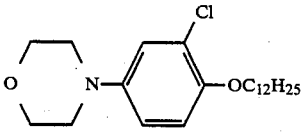
(131)
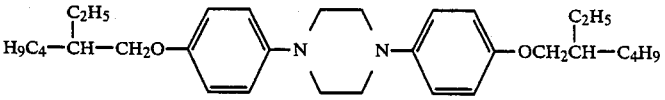
(132)
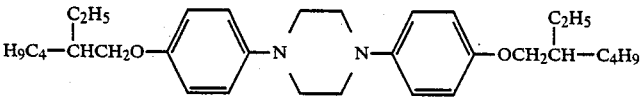

-continued

Example compounds (133)

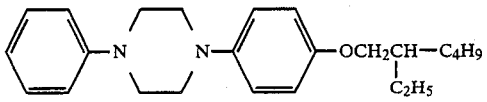

(134)

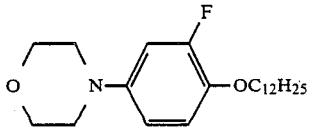

Below are typical examples of synthesizing a compound, expressed by the general formula [I], for use in the present invention.

SYNTHESIS EXAMPLE 1

[Example compound (1)]

Potassium carbonate of 15.4 g and 21.6 g of 1,4-dibromobutane were added to 200 cc of ethanol, and 30.5 g of P-tetradecyloxyaniline was added in ten minutes while being stirred at a room temperature. After being refluxed for 20 hours, this reacted mixture was filtered, and ethanol was removed under a reduced pressure. Two hundred cc of ethyl acetate was added to the resultant mixture, which was washed with water three times. After ethyl acetate was removed under a reduced pressure, the residue was columnchromatographed to provide 17.5 g of colorless crystal whose melting point being 61° to 62° C.

This substance was identified by the FD mass spectrum method and the NMR (nuclear magnetic resonance) method, with the example compound (1).

SYNTHESIS 2

[Example compound (11)]

Potassium carbonate of 15.4 g and 14.3 g of bis(-chloroethyl)ether were added to 200 cc of ethanol, and 27.7 g of p-dodecyloxyaniline was added in ten minutes while being stirred at room temperature. After being refluxed for 20 hours, this reacted mixture was filtered, and ethanol was removed under a reduced pressure. Two hundred cc of ethyl acetate was added to the resiltant mixture, which was washed with water three times. After ethyl acetate was removed under a reduced pressure, the residue was columnchromatographed to provide 16.5 g of colorless crystal whose melting point being 54° to 55° C.

This substance was identified, by the FD mass spectrum method and the NMR (nuclear magnetic resonance) method, with the example compound (11).

According to the present invention, a compound, expressed by the general formula [I] is contained in at least one layer, favorably a silver halide emulsion layer, even more preferably a silver halide emulsion layer containing a magenta coupler, of the photographic structural layers, which constitute a silver halide photographic light-sensitive material, that is, a photosensitive silver halide emulsion layer and non-photosensitive layers such as a protective layer, intermediate layer, filter layer, subbing layer, antihalation layer, and other auxiliary layers. The preferable amount of the compound represented the general formula [I] is 0.1 to 4 moles, more preferably 0.5 to 3 moles of thecompound per mole of the magenta coupler be added.

A silver halide photographic light-sensitive material of the present invention may be used as a color negative or positive film, or as a color photographic paper, but the effect of the invention is best attained when the material is used as a color photographic layer.

A silver halide photographic light-sensitive material of the present invention may be used for both monocolor and multicolor applications, typically c color photograhic paper as mentioned. Due to the use of the subtractive color process for color reproduction, a multicolor silver halide photographic light-sensitive material is normally of a multilayer structure which comprises silver halide emulsion layers respectively containing magenta, yellow, and cyan couplers and non-photosensitive layers provided on a support in an appropriate number and order of layers, but the number and order of layers may be changed as appropriate, depending on the application and emphasized performance.

Although a wide range of well-known couplers, including 1,2-pyrazolo-5-ones can be used to form magenta dyes for use in a silver halide photographic light-sensitive material of the present invention, the compounds expressed by the following general formula [M-I] are especially preferred.

General formula [M-I]

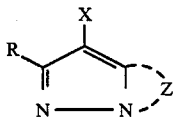

With a magenta coupler expressed by the above formula, Z represents a group of nonmetal atoms necessary to form a nitrogen-containing heterocyclic ring and the heterocyclic ring formed with Z may have a substituent.

X represents a hydrogen atom or a substituent which is being capable of splitting off by the reaction with the oxidized product of a color developing agent.

R represents a hydrogen atom or a substituent.

Though not limited, substituents repesented by R are typically an alkyl group, an aryl group, an anilino group, an acylamino group, a sulfonamido group, an alkylthio group, an arylthio group, an alkenyl group, and a cycloalkyl group. Others examples are a halogen atom, a cycloalkenyl group, an alkinyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic oxy group, a siloxy group, an acyloxy group, a carbamoyloxyl group, an amino group, an alkylamino group, an imido group, an ureido group, a sulfamoyl group, an amino group, an alkoxycarbonylamino group, an aryloxycarbonylamino group, an alkoxycarbonyl group, an aryloxycarbonyl group, a heterocyclic thio group, a spiro compound residue, and a bridged hydrocarbon compound residue.

A straight-chained or branched alkyl group having 1 to 32 carbon atoms is advantageous as the alkyl group represented by R.

A phenyl group is advantageous as the aryl group represented by R.

The acylamino group represented by R include an alkylcarbonylamino group and an arylcarbonylamino group.

The sulfonamido groups represented by R include an alkylsulfonylamino group and an arylsulfonylamino group.

As the alkyl and aryl components of the alkylthio and arylthio groups represented by R, the alkyl and aryl groups mentioned above are available.

A straight-chained or branched alkenyl group having 2 to 32 carbon atoms is advantageous as the alkenyl group represented by R, and a cycloalkyl group having 3 to 12, especially 5 to 7 carbon atoms, is advantageous as the cycloalkyl group represented by R.

A cycloalkenyl group having 3 to 12, especially 5 to 7 carbon atoms, is advantageous as the cycloalkenyl group represented by R.

The sulfonyl groups represented by R include an alkylsulfonyl group and an arylsulfonyl group.

The sulfinyl groups represented by R include an alkylsulfinyl group and an arylsulfinyl group.

The phosphonyl groups represented by R include an alkylphosphonyl group, an alkoxyphosphonyl group, an aryloxyphosphonyl group, and an arylphosphonyl group.

The acyl groups represented by R include an alkylcarbonyl group and an arylcarbonyl group.

The carbamoyl groups represented by R include an alkylcarbamoyl group and an arylcarbamoyl group.

The sulfamoyl groups represented by R include an alkylsulfamoyl group and an arylsulfamoyl group.

The acyloxy groups represented by R include an alkylcarbonyloxy group and an arylcarbonyloxy group.

The carbamoyloxy groups represented by R include an alkylcarbamoyloxy group and an arylcarbamoyloxy group.

The ureido groups represented by R include an alkylureido group and an arylureido group.

The sulfamoylamino groups represented by R include an alkysulfamoylamino group and an arylsulfamoylamino group.

As the heterocyclic group represented by R, a 5- to 7-membered group, more specifically a 2-furyl group, a 2-thienyl group, a 2-pyrimidinyl group, or a 2-benzothiazolyl group, is preferred.

As the heterocyclic oxy group represented by R, an oxy group having 5- to 7-membered heterocyclic group, such as a 3,4,5,6-tetrahydropyranyl-2-oxy ring or a 1-phenyltetrazole-5-oxy group, is preferred.

As the heterocyclic thio group represented by R, a 5- to 7-membered heterocyclic thio group, such as a 2-pyridylthio group, a 2-benzothiazorylthio group, or a 2,4-diphenoxy-1,3,5-triazole-6-thio group, is preferred.

The siloxy groups represented by R include a trimethylsiloxy group, a triethylsiloxy group, and a dimethylbutylsiloxy group.

The imido groups represented by R include an succinic imido group, a 3-heptadecyl succinic imido group, a phthalimido group, and a glutarimido group.

The spiro compound residues represented by R include a spiro[3.3]-heptane-1-yl.

The bridged hydrocarbonate compound residues represented by R include a bicyclo[2.2.1]heptane-1-yl, a tricyclo[3.3.1.1$^{3,7}$]decane-1-yl, 7,7-dimethyl-bicyclo[2.2.1]heptane-1-yl.

Substituents represented by X, which are capable of splitting off by the reaction with the oxidized product of a color developing agent, include a halogen atom (a chlorine atom, a bromine atom, a florine atom), an alkoxy group, an aryloxy group, a heterocyclic oxy, an acyloxy group, a sulfonyloxy group, an alkoxycarbonyloxy group, an aryloxycarbonyl group, an alkloxalyloxy group, an alkoxyoxalyloxy group, an alkylthio group, an arylthio group, a heterocyclicthio group, an alkyloxythiocarbonylthio group, an acylamino group, a sulfonamide group, a heterocyclic ring bonded via an N atom, an alkyloxycarbonylamino group, an aryloxycarbonylamino group, and a carboxyl group, and

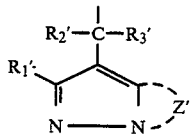

($R_1'$ represents the same as R mentioned earlier, Z' represents the same as Z mentioned earlier, and $R_2'$ and $R_3'$ represent a hydrogen atom, an aryl group, an alkyl group, or a heterocyclic group). A halogen atom, especially a chlorine atom, is preferred.

The nitrogen-containing heterocyclic rings formed by Z or Z' include a pyrazole ring, an imidazole ring, a triazole ring, and a tetrazole ring. The above rings may have any of the substituents same as those for R mentioned earlier.

The groups expressed by the general formula [M-I] are more specifically expressed by the following general formulas [M-LL] though [M-VII].

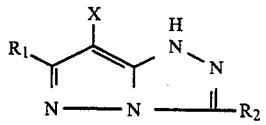

General formula [M-II]

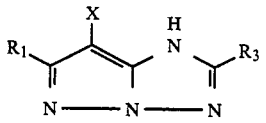

General formula [M-III]

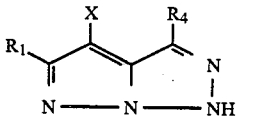

General formula [M-IV]

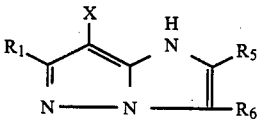

General formula [M-V]

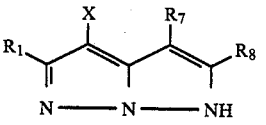

General formula [M-VI]

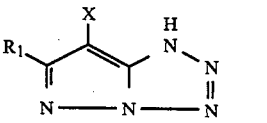

General formula [M-VII]

In the above general formulas [M-II] through [M-VII], $R_1$ through $R_8$ and X represent the same as R and X mentioned earlier.

Among the groups expressed by the general formula [M-I], the preferable ones are expressed by the following formula [M-VIII].

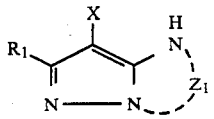

Generla formula [M-VIII]

where $R_1$, X, and $Z_1$ represent the same as R, X and Z in the general formula [M-I].

Among the magenta couplers expressed by the above general formulas [M-II] through [M-VII], especially preferable ones are expressed by the general formula [M-II].

Among the substituents represented by R and $R_1$, the most preferable ones are expressed by the following general formula [M-IX].

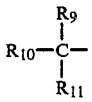

General formula [M-IX]

where $R_9$, $R_{10}$, $R_{11}$ represent the same as R mentioned earlier.

Also, two of the $R_9$, $R_{10}$, and $R_{11}$, for example, $R_9$ and $R_{10}$ may bond together to form either a saturated or unsaturated ring, such as a cycloalkane ring, a cycloalkane ring, or a heterocyclic ring, whereby $R_{11}$ may additionally link to form a bridged hydrocarbon compound redidue.

Among the groups expressed by the general formula [M-IX], the preferable ones are as follows:

(i) At least two of $R_9$ through $R_{11}$ are alkyl groups.

(ii) One of $R_9$ through $R_{11}$, for example, $R_{11}$ is a hydrogen atom, and other two, in this case, $R_9$ and $R_{10}$ bond to form a cycloalkyl group together with a root carbon atom.

More specifically, in (i), the groups, wherein two of $R_9$ through $R_{11}$ are alkyl groups and the third one is a hydrogen atom or an alkyl group, are even more faborable.

As the substituents which the rings formed by Z in the general formula [M-I] and the rings formed by $Z_1$ in the general formula [M-VIII] may have, and as $R_2$ through $R_8$ in the general formulas [M-II] to [M-VI], the ones expressed by the following general formula [M-X] are preferred.

$$-R_{12}-SO_2-R_{13}$$

General formula [M-X]

where $R_{12}$ represents an alkylene group and $R_{13}$ represents an alkyl group, a cycloalkyl group, or an aryl group.

The alkylene group represented by $R_{12}$ should preferably have more than two carbon atoms in the straight-chained portion, more specifically three or six, and may be either straight-chained or branched.

As the cycloalkyl groups represented by $R_{13}$, 5- or 6-membered groups are preferred.

Typical compounds of the present invention are shown below:

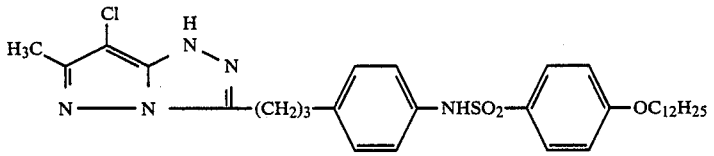

M-1

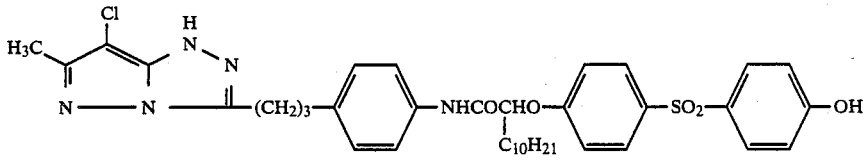

M-2

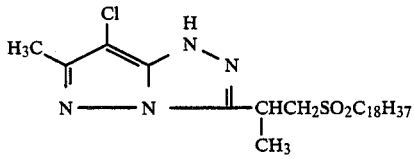

M-3

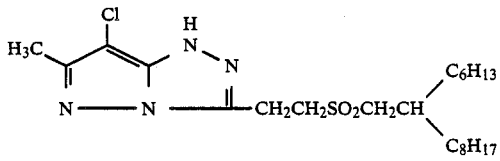

M-4

-continued
M-5
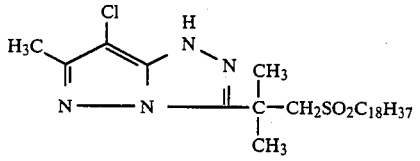
M-6
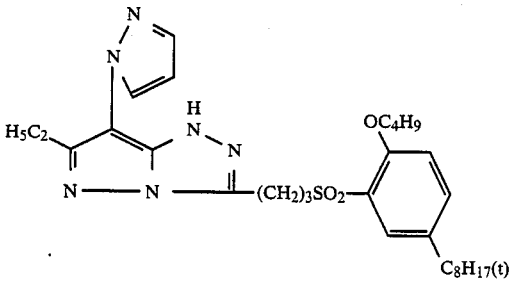
M-7
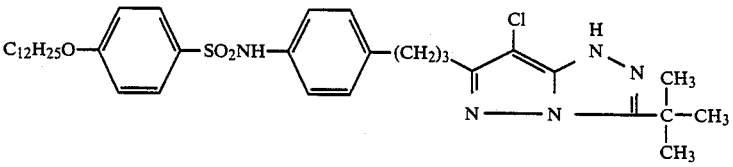
M-8
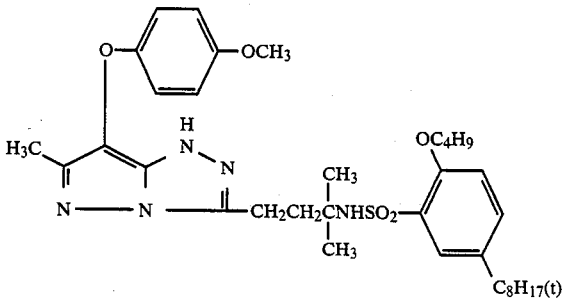
M-9
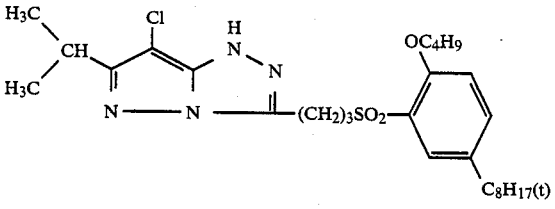
M-10
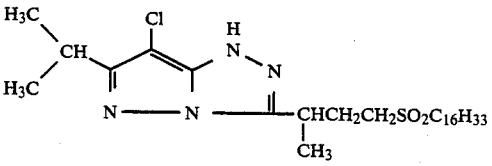
M-11
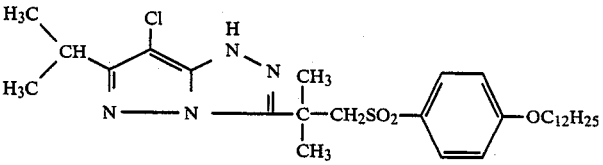
M-12
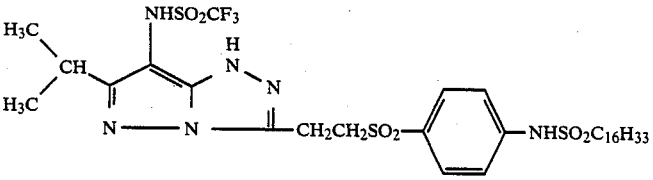

-continued
M-13
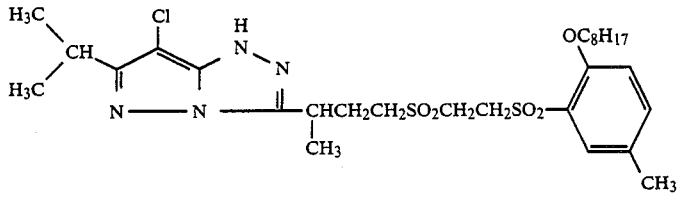
M-14
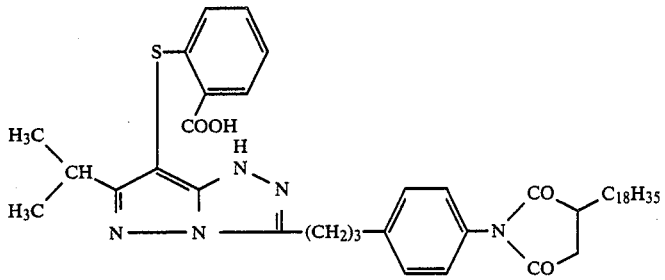
M-15
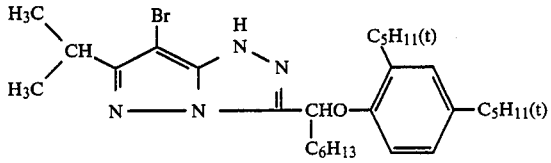
M-16
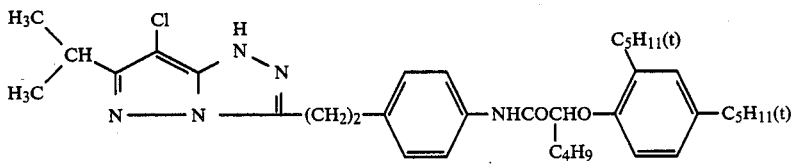
M-17
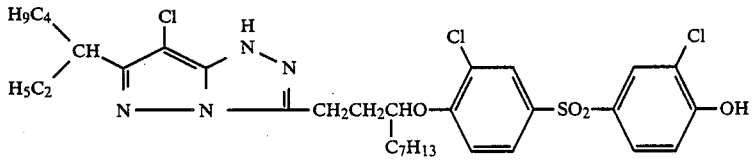
M-18
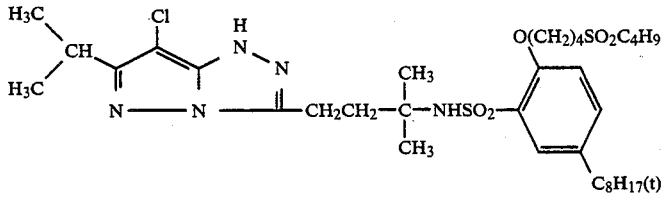
M-19
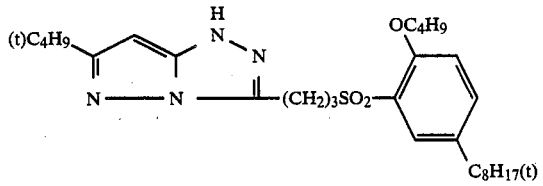
M-20
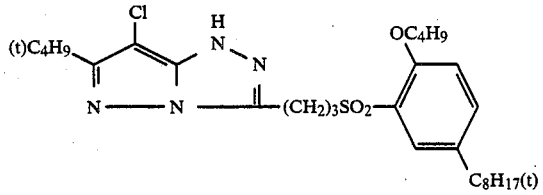

-continued
M-21
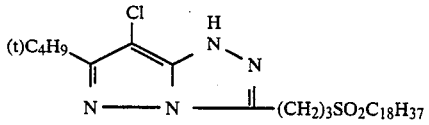
M-22
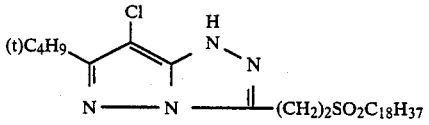
M-23
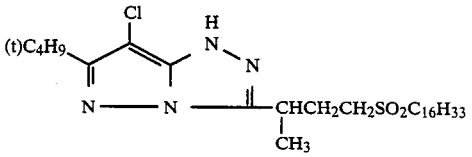
M-24
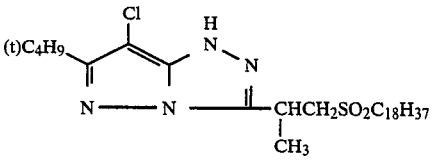
M-25
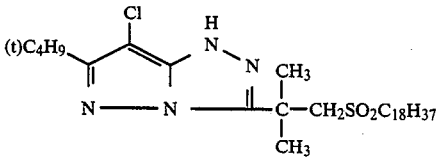
M-26
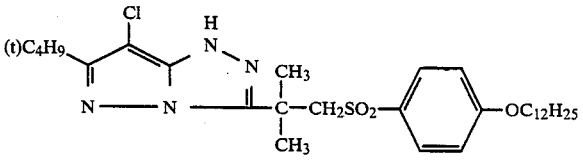
M-27
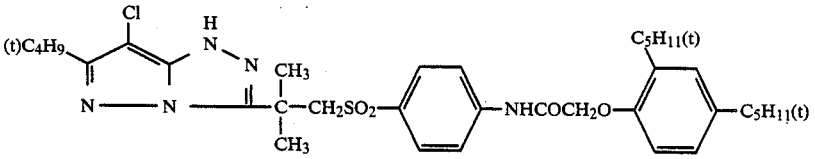
M-28
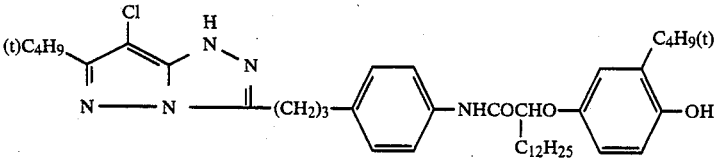
M-29
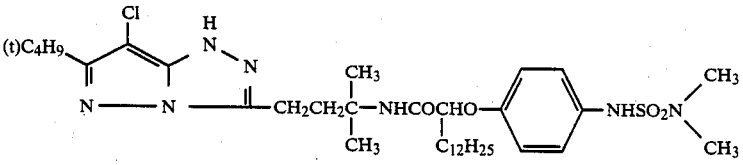

-continued
M-30
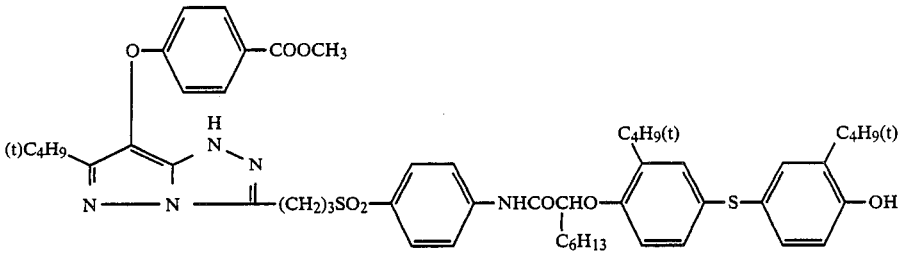
M-31
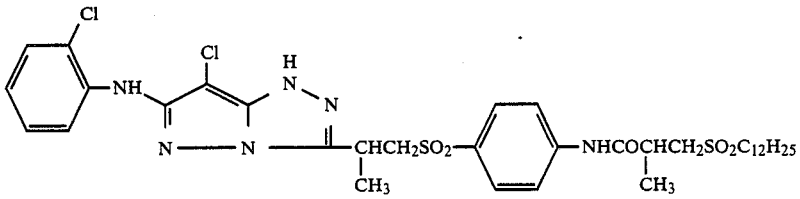
M-32
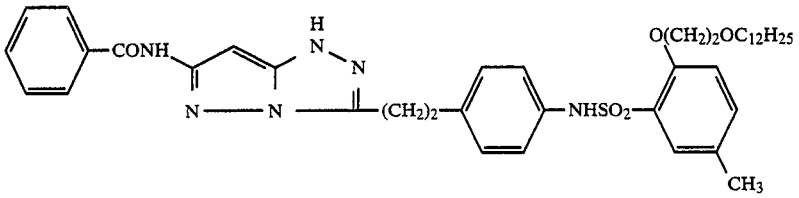
M-33
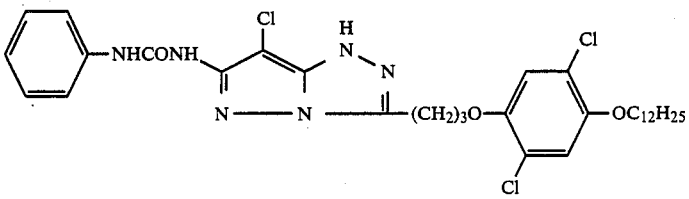
M-34
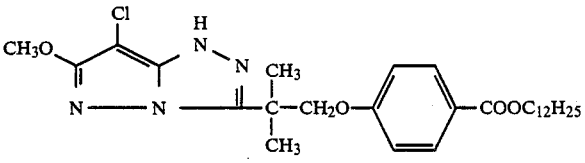
M-35
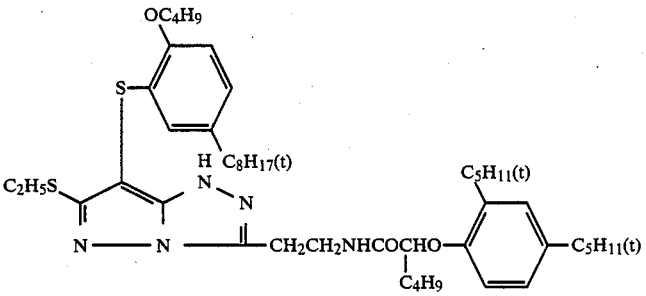
M-36
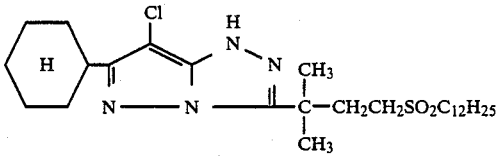

-continued
M-37
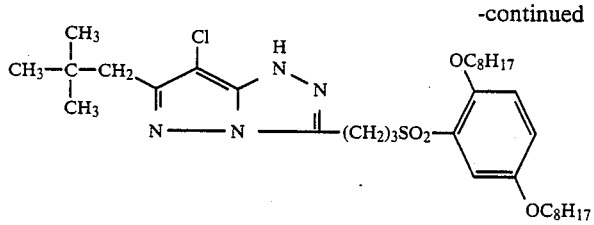
M-38
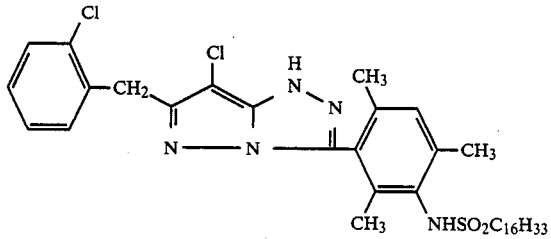
M-39
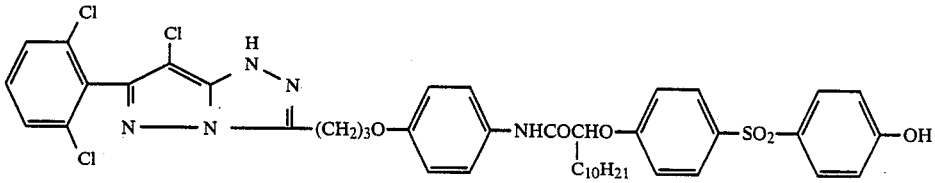
M-40
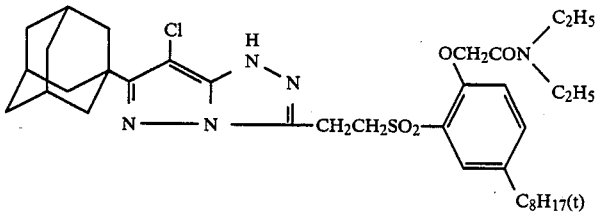
M-41
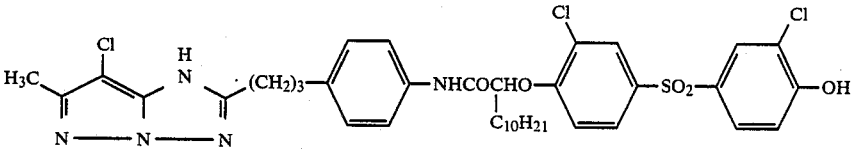
M-42
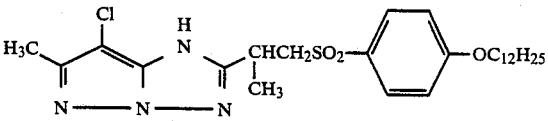
M-43
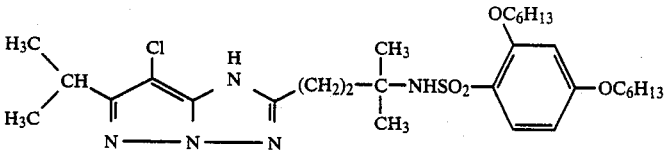
M-44
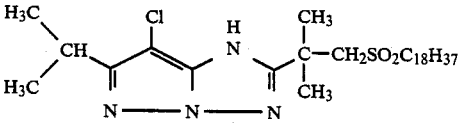
M-45
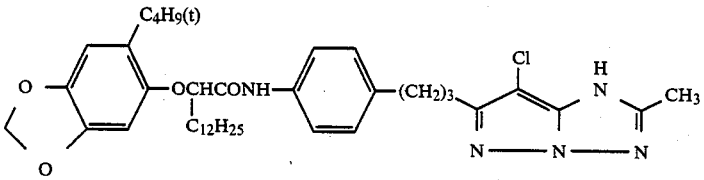

-continued
M-46
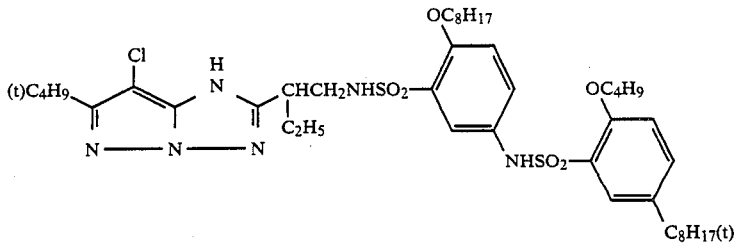
M-47
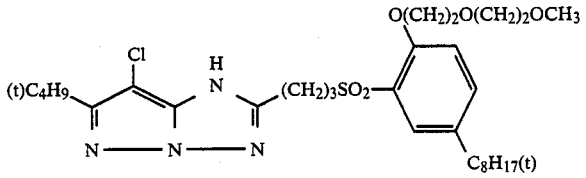
M-48
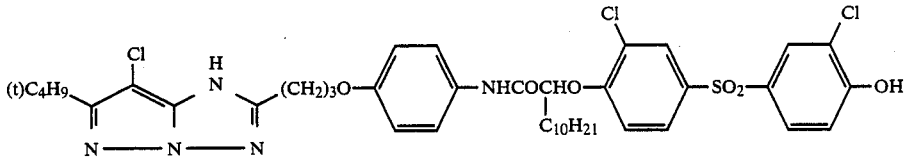
M-49
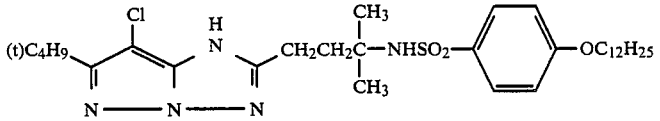
M-50
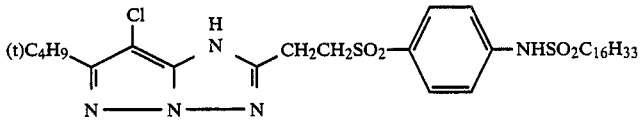
M-51
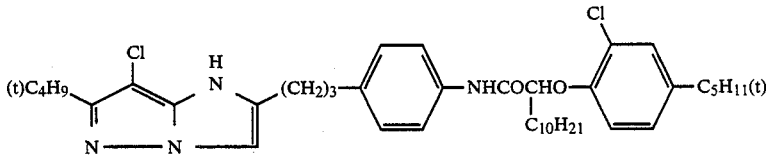
M-52
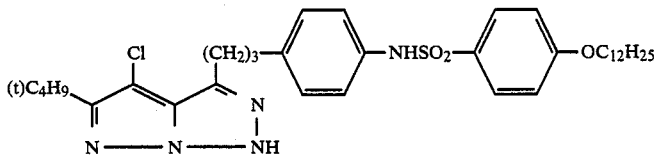
M-53
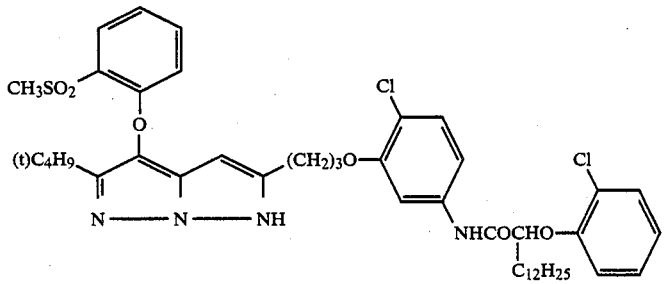
M-54
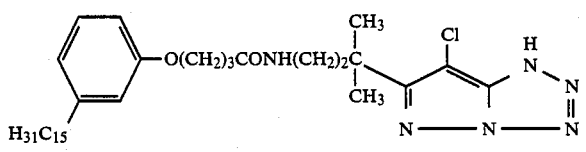

-continued

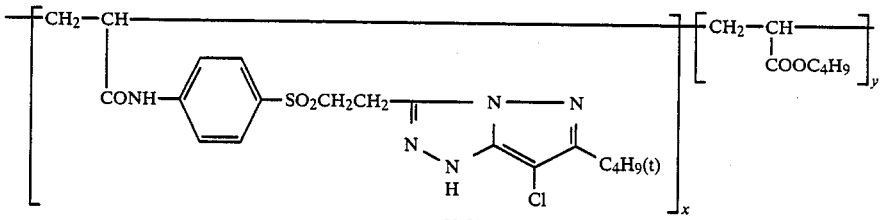

M-55

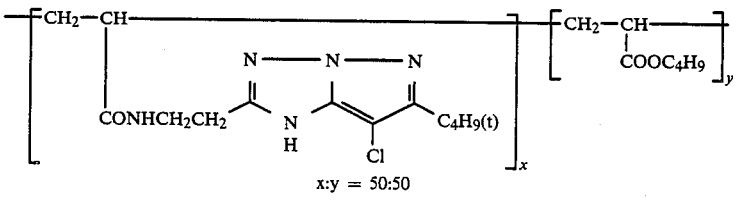

M-56

General formula [II]

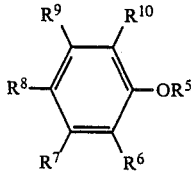

Apart from the typical magenta couplers illustrated above, examples expressed by the general formula [M-I] include the compounds with Nos. 1 through 4,6,8 through, 17, 19 through 24, 26 through 43, 45 through 59, 61 through 104, 106 through 121, 123 through 162, and 164 through 223 disclosed on the pages 66 through 122 of Japanese Patent O.P.I. Publication No. 166339/1987.

Those versed in the art can easily synthesize the magenta couplers expressed by the previously mentioned general formula [M-I] by referring to Journal of the Chemical Society, Perkin I (1977), p.p. 2047 through 2052, U.S. Pat. No. 3,725,067, Japanese Pat. O.P.I. Publication No. 99437/1984, No. 42045/1983, No. 162548/1987, No. 171956/1984, No. 33552/1985, No. 43659/1985, No. 172982/1985, and No. 190779/1985.

Normal 16, $1\times10^{-3}$ to 1 mole of a the magenta couplers expressed by the general formula [M-I], preferably $1\times10^{-2}$ to $8\times10^{-1}$ mole, can be used per mole of silver halide.

The magneta couplers expressed by the general formula [M-I] may be employed in combination with other types of magenta couplers.

If at least one of the compounds expressed by the general formula [I] is employed in combination with a magenta coupler expressed by the general formula [M-I], a magenta dye-image obtained from the magenta coupler drastically improves in fastness to light.

The above magenta coupler and a compound of the present invention expressed by the general formula [I] (hereinafter referred to as the dye-image stabilizer of the present invention) should preferably be used in the same layer, but the stabilizer may be used in a layer adjacent to the layer where the coupler exist.

Other than the magenta dye-image stabilizer of the present invention, a silver halide photographic light-sensitive material of the present invention may also use dye-image stabilizers disclosed in the pages 106 through 120 of Japanese patent application No. 188344/1986, that is, phenol and phenylether compounds expressed by the following general formula [II].

Where $R^5$ represents a hydrogen atom, or an alkyl group, an alkenyl group, an aryl group, or a hetercyclic group each allowed to have a substituent; $R^6$, $R^7$, $R^9$ and $R^{10}$ respectively represent a hydrogen atom, a halogen atom, or a hydroxy group, an alkyl group, an alkenyl group, an aryl group, an alkoxy group, or an acylamino group each allowed to have a substituent; $R^8$ represents an alkyl group, a hydroxy group, an aryl group, or an alkoxy group allowed to have a substituent. $R^5$ and $R^6$ may bond to each other to form a 5- or 6-membered ring. When this occurs, $R^8$ represents a hydroxy group or an alkoxy group. $R^5$ and $R^6$ may bond to each other to form a methylenedioxy ring. Additionally, $R^7$ and $R^8$ may mutually close to form a 5-membered hydrocarbon ring. When this occurs, $R^5$ represents an alkyl group, an aryl group, or a heterocyclic group. It should be noted that cases wherein $R^5$ and $R^8$ respectively represent a hydrogen atom and a hydroxy group are excluded.

Below typified are the compounds, expressed by the general formula [II], which are preferably used for the present invention.

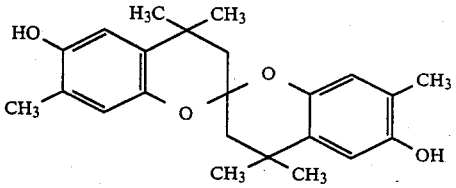

II-1

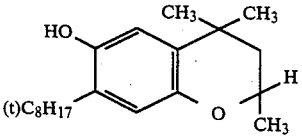

II-2

-continued
II-3
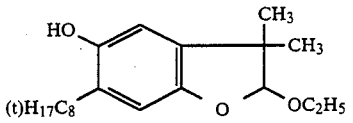
II-4
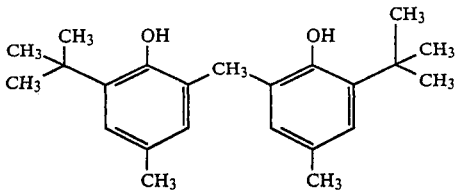
II-5
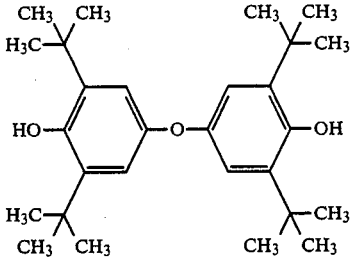
II-6
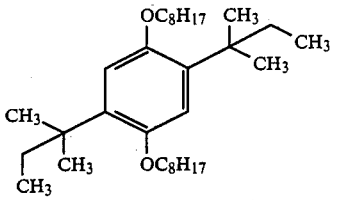
II-7
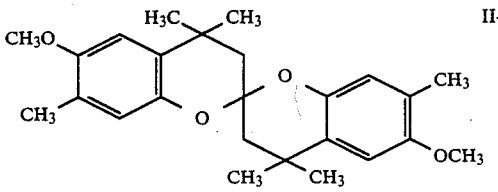
II-8
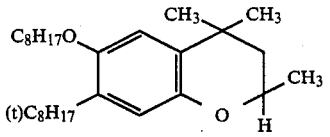
II-9
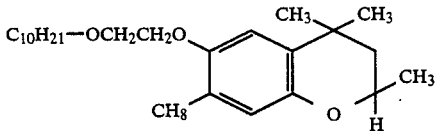
II-10
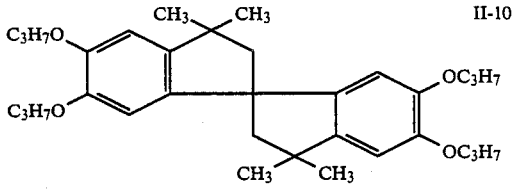
II-11
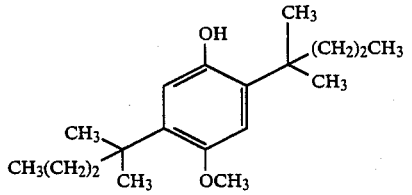
-continued
II-12
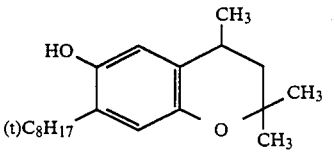
II-13
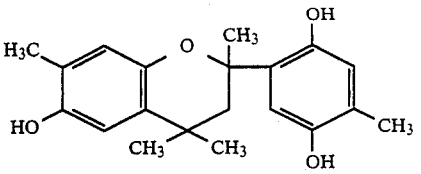
II-14
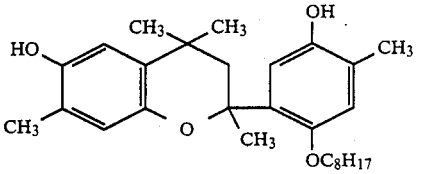
II-15
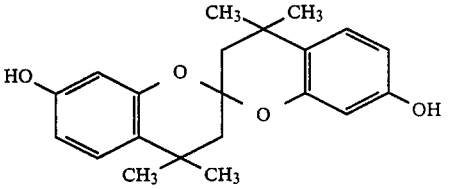
II-16
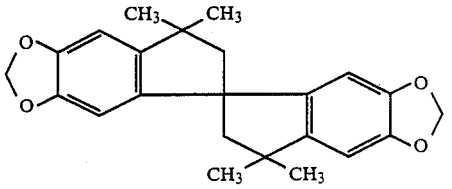
II-17
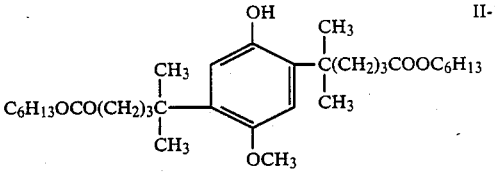
II-18
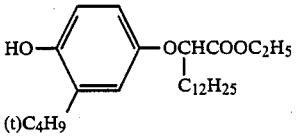
II-19
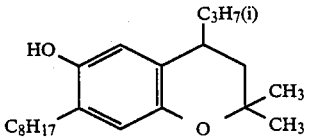
II-20
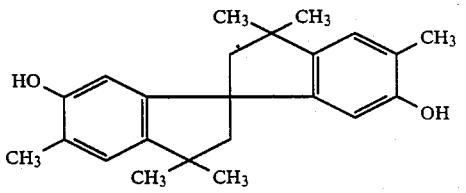

Preferably, $1\times10^{-2}$ to 5 moles, more specifically $1\times10^{-1}$ to 2 moles, of the phenol or phenylether compounds expressed by the general formula [II] should be used per mole of the magenta coupler to the present invention.

The cyan couplers preferably used in a silver halide photographic light-sensitive material of the present invention include couplers represented by the following general formula [C].

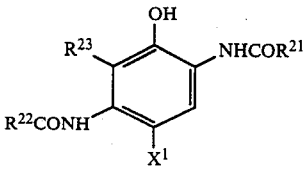

General formula [C]

where $R^{21}$ and $R^{22}$ independently represent an alkyl group, a cycloalkyl group, an alkenyl group, an aryl group, or a heterocyclic group each allowed to have a substituent; $R^{23}$ represents a hydrogen atom, a halogen atom, or an alkyl atom or an alkoxy group each allowed to have a substituent. $R^{22}$ and $R^{23}$ may bond together to form a ring. $X^1$ represents a hydrogen atom or a group that in capable of splitting off by the reaction with the oxidized product of a color developing agent.

In the above general formula [C], $R^{21}$ and $R^{22}$ independently represent an alkyl group with 1 to 32 carbon atoms, alkenyl group with 2 to 32 carbon atoms, and cylcoalkyl group with 3 to 12 carbon atoms. Alkyl and alkenyl groups may be straight-chained or branched. These alkyl, alkenyl, and cycloalkyl may have a substituent.

As the aryl group represented by $R^{21}$ and $R^{22}$, a phenyl group is preferred.

As the heterocyclic group represented by $R^{21}$ and $R^{22}$, a 5- or 7-membered group is preferred, and may be substituted or condensed.

$R^{21}$ should preferably represent a halogen substituted phenyl group.

$R^{23}$ represents a hydrogen atom, a halogen atom, an alkyl group, or an alkoxy group, but a hydrogen atom is advantageous.

As the ring formed jointly by $R^{22}$ and $R^{23}$, a 5- or 6-membered ring is preferred.

The groups, represented by $X^1$ in the general formula [C] and is capable of splitting off by the reaction with an oxidized product of color developing agent, include groups well-known in the art.

Typical cyan couplers represented by the general formula [C] are shown below:

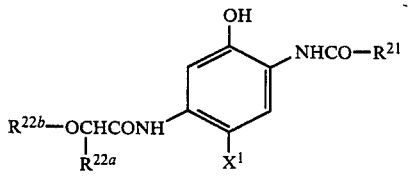

| Cyan coupler No. | $R^{21}$ | $X^1$ | $R^{22a}$ | $R^{22b}$ |
|---|---|---|---|---|
| C-1 | 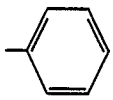 | —Cl | $-C_{12}H_{25}$ | 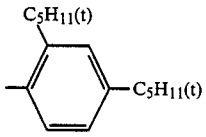 |
| C-2 | 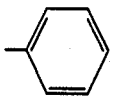 | —Cl | $-C_{12}H_{25}$ | 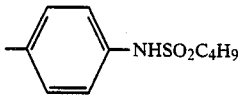 |
| C-3 | 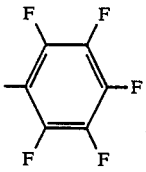 | —Cl | $-C_4H_9$ | 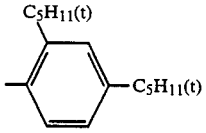 |
| C-4 | 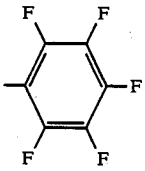 | $-OC_8H_{17}$ | $-C_{12}H_{25}$ | 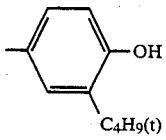 |

-continued
| | | | | |
|---|---|---|---|---|
| C-5 | 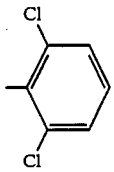 | 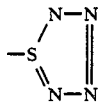 | $-C_{12}H_{25}$ | 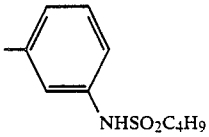 |
| C-6 | 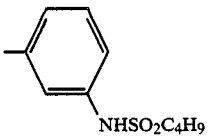 | $-Cl$ | $-C_4H_9$ | 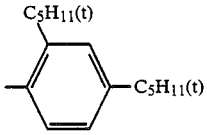 |
| C-7 | 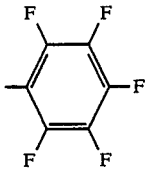 | $-Cl$ | $-C_{12}H_{25}$ | 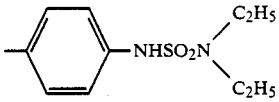 |
| C-8 | 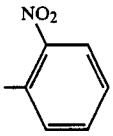 | 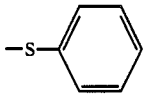 | $-C_4H_9$ | 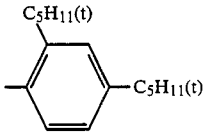 |
| C-9 | 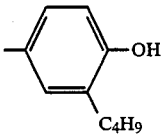 | $-Cl$ | $-C_4H_9$ | 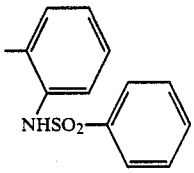 |
| C-10 | 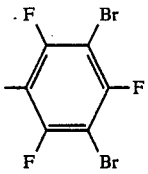 | $-Cl$ | $-C_4H_9$ | 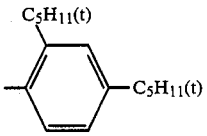 |
| C-11 | 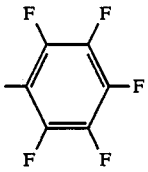 | $-H$ | $-C_4H_9$ | 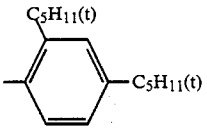 |
| C-12 | 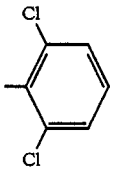 | $-Cl$ | $-C_{12}H_{25}$ | 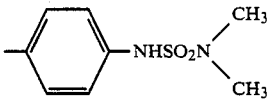 |
| C-13 | 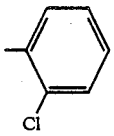 | $-Cl$ | $-C_6H_{13}$ | 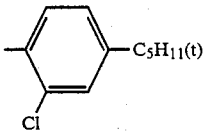 |

-continued

| | | | | |
|---|---|---|---|---|
| C-14 | 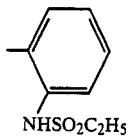 | —Cl | —$C_2H_5$ | 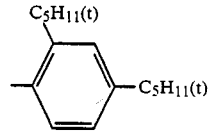 |
| C-15 | 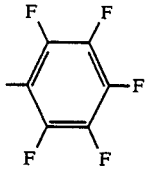 | —Cl | —$CH(CH_3)_2$ | 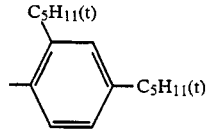 |
| C-16 | 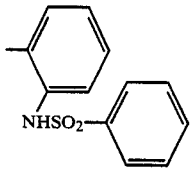 | —Cl | —$C_{10}H_{21}$ | 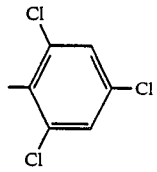 |

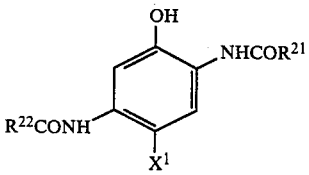

| Cyan coupler No. | $R^{21}$ | $X^1$ | $R^{22}$ |
|---|---|---|---|
| C-17 | 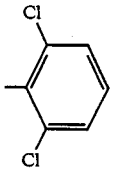 | —Cl | 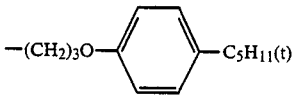 |
| C-18 | —$C(CH_3)_3$ | —Cl | 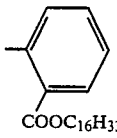 |
| C-19 | 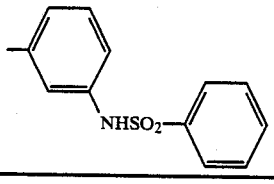 | —H | 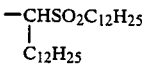 |

The above cyan couplers of the present invention are disclosed in Japanese Patent O.P.I. Publication No. 31935/1984, No. 121332/1984, No. 124341/1984, No. 139352/1984, No. 100440/1984, No. 166956/1984, No. 146050/1984, No. 112038/1975, No. 109630/1978, No. 163537/1980, and U.S. Pat. No. 2,895,826.

Normally, $1\times10^{-3}$ to 1 mole of the cyan coupler of the present invention, preferably $1\times10^{-2}$ to $8\times10^{-1}$ moles, can be used per mole of silver halide.

The coupler of the present invention can be used with other types of couplers, preferably with 2-chloro-3-alkyl-5-acylaminophenol cyan couplers disclosed in U.S. Pat. No. 2,423,730, U.S. Pat. No. 2,474,293, Japanese Patent O.P.I. Publication No. 117249/1985, No. 205446/1985, and No. 99141/1986.

The yellow couplers preferably used for the halide silver photographic light-sensitive material of the present invention are described below.

The yellow couplers represented by the following general formula [Y] are preferred.

General formula [Y]

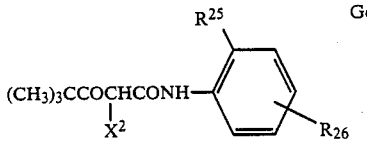

where $R^{25}$ represents a hydrogen atom, a halogen atom, or an alkoxy group allowed to have a substituent; $R^{26}$ represents the groups defined as —NHCOR$^{27}$, —NHSO$_2$R$^{27}$, —COOR$^{27}$, or —SO$_2$NR$^{27}$R$^{28}$ (R$^{27}$ and R$^{28}$ respectively represent an alkyl group allowed to have a substituent). $X^2$ represents a hydrogen atom or a group that in capable of splitting off by the reaction with the oxidized product of a color developing agent.

As the group, represented by $X^2$ in the general formula [Y], that is capable of splitting off by the reaction with the oxidized product of a color developing agent, a nitrogen-bonded heterocyclic group and an aryloxy group are preferred.

Typical yellow couplers represented by the above general formula [Y] are listed below.

Y-1

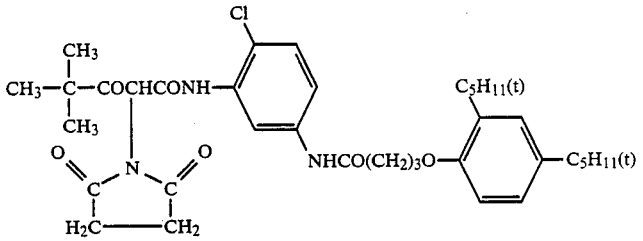

Y-2

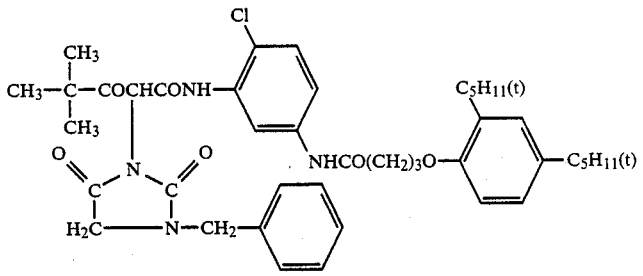

Y-3

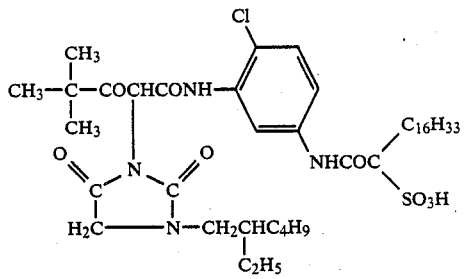

Y-4

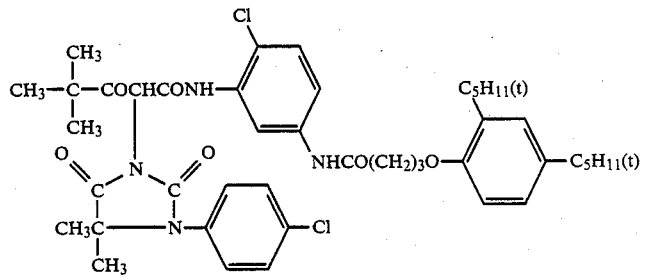

-continued
Y-5
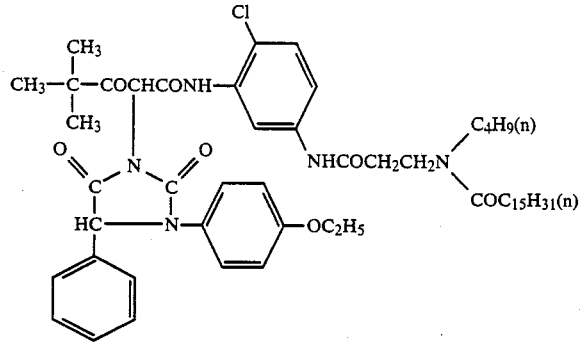
Y-6
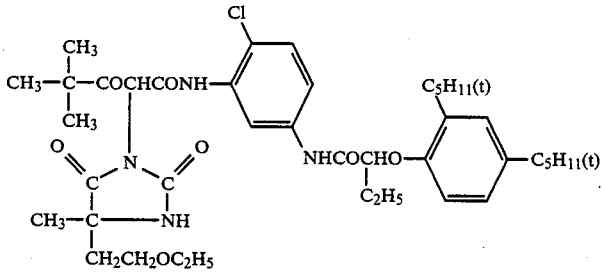
Y-7
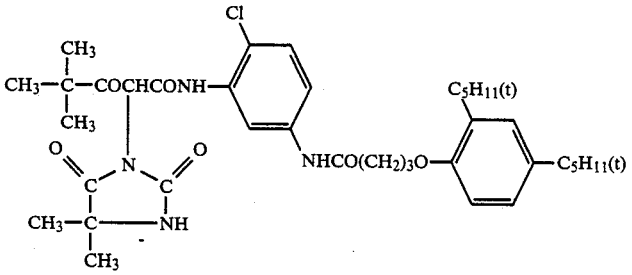
Y-8
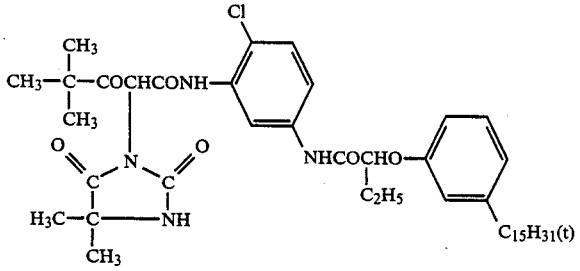
Y-9
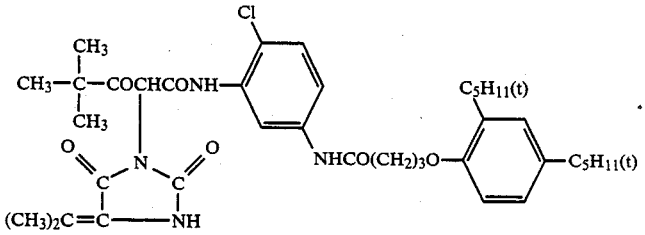

-continued
Y-10
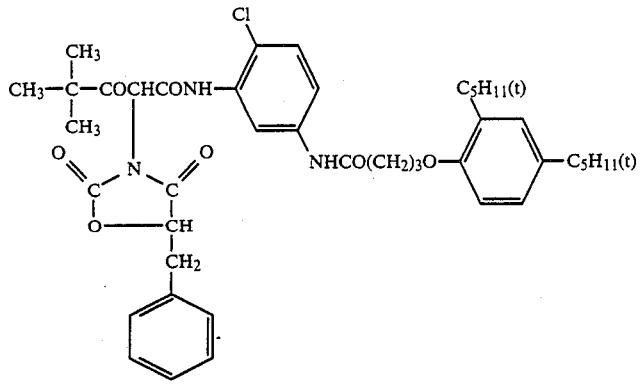
Y-11
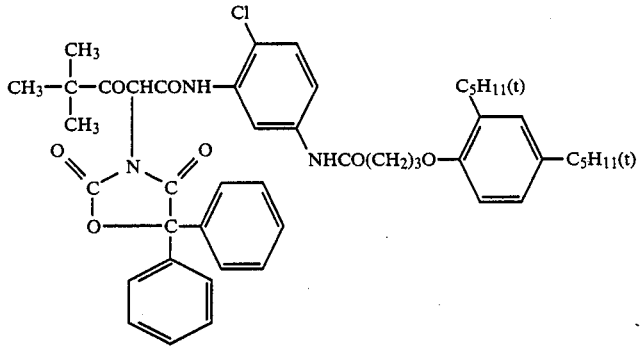
Y-12
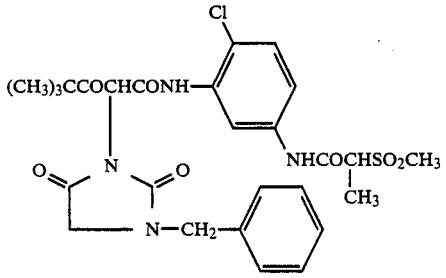
Y-13
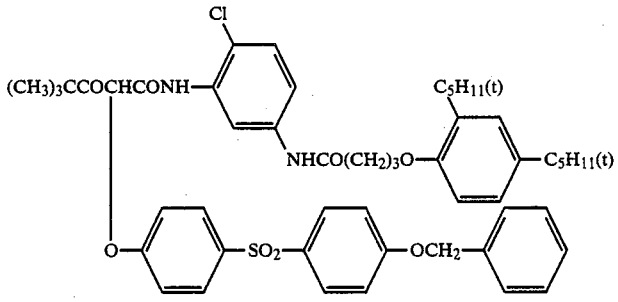
Y-14
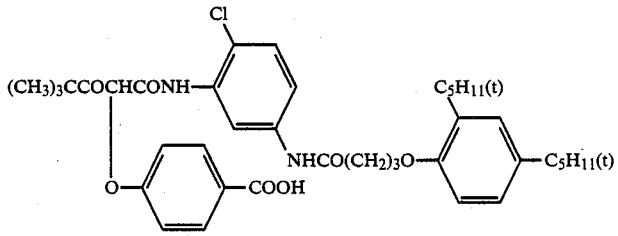

-continued

Y-15

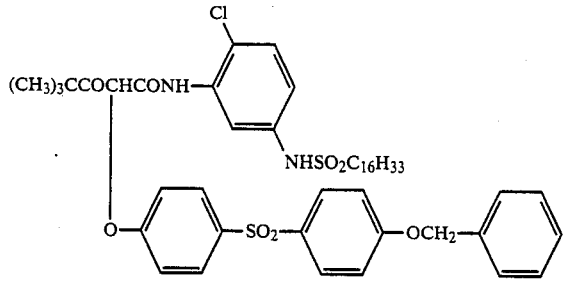

These yellow couplers can be synthesized according to the methods disclosed in West Germany OLS Patent No. 2,057,941, No. 2,163,812, Japanese Patent O.P.I. Publication No. 26136/1972, No. 29432/1973, No. 65231/1975, No. 3631/1976, No. 50734/1976, No. 102636/1976, Japanese Patent Examined Publication No. 33410/1976, Japanese Patent O.P.I. Publication No. 66835/1973, No. 94432/1973, No. 1229/1974, No. 10736/1974, and Japanese Patent Examined Publication No. 25733/1977.

Normally, $1\times10^{-3}$ to 1 mole of the coupler represented by the above general formula [Y], preferably $1\times10^{-2}$ to $8\times10^{-1}$ moles, can be used per mole of silver halide.

In addition to using the dye-image stabilizers of the present invention expressed by the general formula [I] mentioned earlier the photographic light-sensitive material of the present invention preferably contain one of the compounds, expressed by the previously mentioned general formula [III] or [IV], in the emulsion layer containing yellow coupler and/or cyan coupler.

General formula [III]

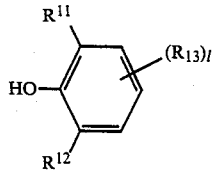

where $R^{11}$ and $R^{12}$ respectively represents an alkyl group allowed to have a substituent; $R^{13}$ represents an alkyl group allowed to have a substituent, $—NHR^{14}$, $—SR^{14}$, or $—COOR^{15}$ ($R^{14}$ represents a univalent organic group and $R^{15}$ represents a hydrogen atom or a univalent organic group). I represents an integer from 0 to 3.

The compounds expressed by the previously mentioned general formula [III] are first explained below.

As the alkyl group represented respectively by $R^{11}$ and $R^{12}$, an alkyl group with its $\alpha$-position branched, which has 3 to 8 carbon atoms, is preferred.

The alkyl groups represented by $R^{13}$ may be either straight-chained or branched, and may have a substituent.

The univalent organic groups represented by $R^{14}$ and $R^{15}$ include an alkyl group, an aryl group, a cycloalkyl group, and a heterocyclic group, and may a have substituent.

Among the compounds expressed by the general formula [III], the preferable ones are expressed by the following general formula [IIIa].

General formula [IIIa]

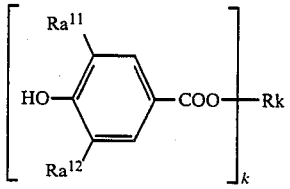

where $Ra^{11}$ and $Ra^{12}$ respectively represent either a straight-chained or branched alkyl group having 3 to 8 carbon atoms, and preferably a t-butyl group and a t-pentyl group; Rk represents a k-valent organic group; k represents an integer from 1 to 6.

The k-valent organic groups represented by Rk include an alkyl group, an alkenyl group, a multi-valent unsaturated hydrocarbon group, an unsaturated hydrocarbon group, an aliphatic-cyclic hydrocarbon group, an aryl group, an arylene group, and a 1,3,5-trisubstituted phenyl group.

Other than the above groups, the examples of Rk include a k-valent organic group bonded to any one of the groups, mentioned above, via —O—, —S—, or $—SO_2—$.

k should preferably be an integer from 1 to 4.

Some of the compounds expressed by the general formula [III] are listed below.

III-1

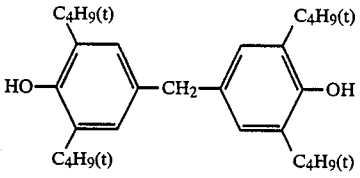

III-2

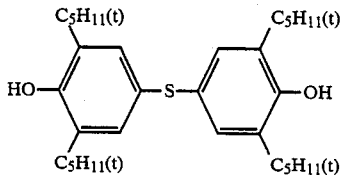

III-3

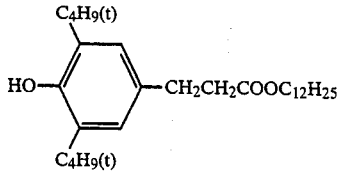

-continued

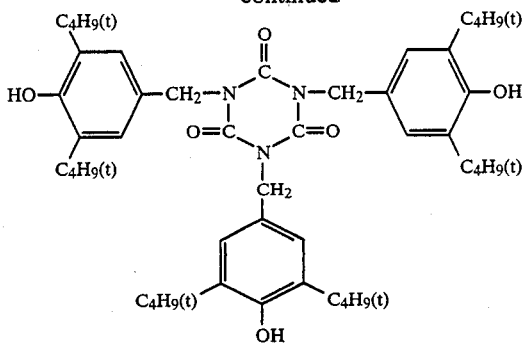

III-4

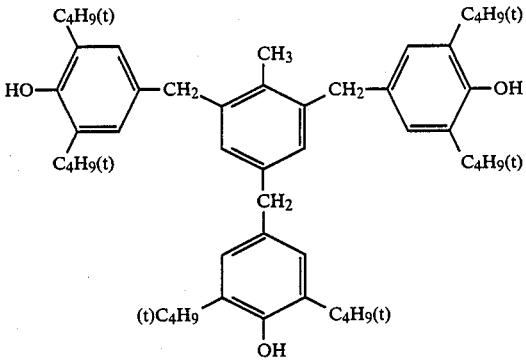

III-5

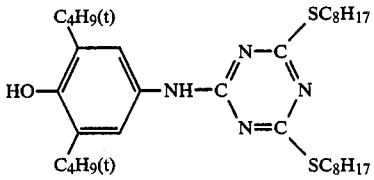

III-6

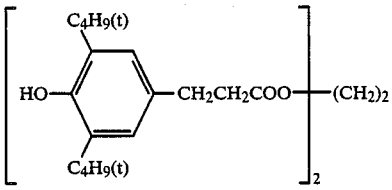

III-7

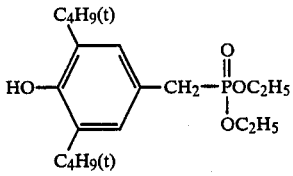

III-8

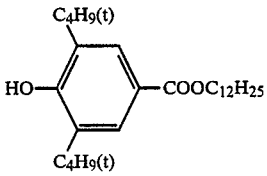

III-9

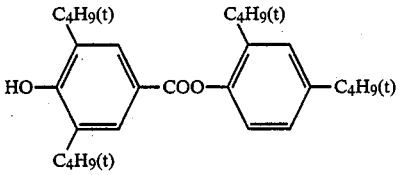

III-10

-continued

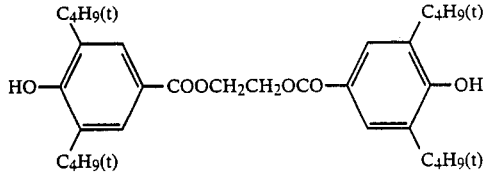

III-11

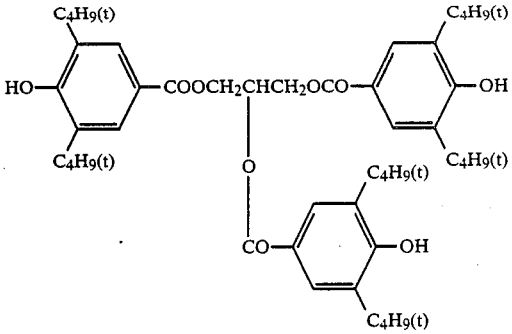

III-12

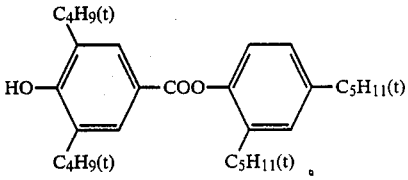

III-13

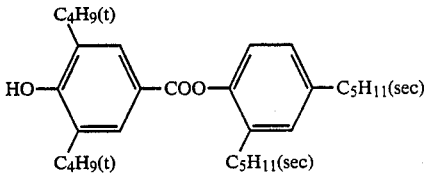

III-14

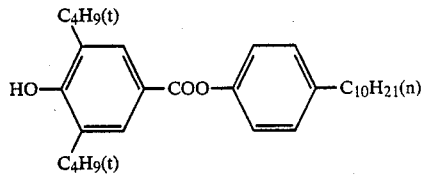

III-15

The compounds expressed by the general formula [VI] are explained below.

General formula [IV]

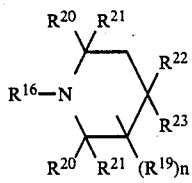

where $R^{16}$ represents a hydrogen atom, a hydroxy group, an oxy radical, —$SOR^{17}$, —$SO_2R^{17}$, or an alkyl group, an alkenyl group, an alkinyl group each allowed to have a substituent, or —$COR^{18}$ ($R^{17}$ represents an alkyl group or an aryl each allowed to have a substituent group and $R^{18}$ represents a hydrogen atom or a univalent organic group); $R^{19}$, $R^{20}$, and $R^{21}$ respectively represent an alkyl group; $R^{22}$ and $R^{23}$ respectively represent a hydrogen atom or —$OCOR^{24}$ ($R^{24}$ represent a univalent organic group). $R^{22}$ and $R^{23}$ may mutually bond to form a heterocyclic group. n represents an integer from 0 to 4.

Alkyl groups having one to 12 carbon atoms, and alkenyl and alkinyl groups having two to four carbon atoms are typically represented by $R^{16}$. The preferable groups for $R^{16}$ are a hydrogen atom, an alkyl group, an alkenyl group, an alkinyl group, and $-COR^{18}$. The univalent organic groups represented by $R^{18}$ include an alkyl group, an alkenyl group, an alkinyl group, and an aryl group.

As the alkyl group represented by each of $R^{19}$, $R^{20}$, and $R^{21}$, a straight-chained or branched alkyl group having one to five carbon atoms is preferred, and a methyl group is particularly preferred.

The univalent organic groups represented by $R^{24}$ in $R^{22}$ or $R^{23}$ include an alkyl group, an alkenyl group, an alkinyl group, an aryl group, an alkylamino group, and an arylamino group. The heterocyclic groups formed by $R^{22}$ and $R^{23}$ combined include the following.

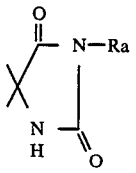

-continued

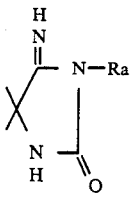

where Ra represents a hydrogen atom, an alkyl group, a cycloalkyl group, or a phenyl group.

Among the compounds expressed by the general formula [IV], the preferred ones are expressed by the following general formula [IVa].

General formula [IVa]

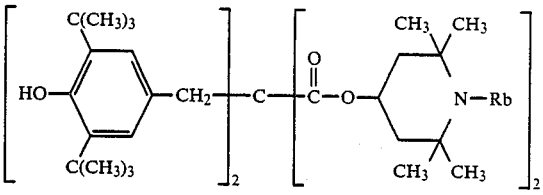

Rb represents an alkyl group, an alkenyl group, an alkinyl group, or an acyl group.

The compounds expressed by the general formula [IV] are typified below.

IV-1

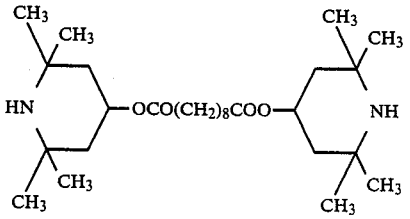

IV-2

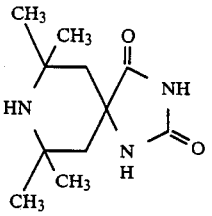

IV-3

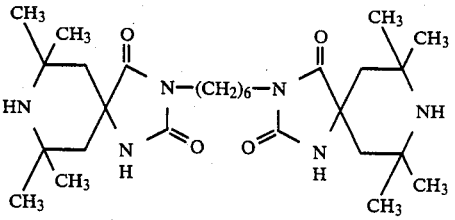

IV-4

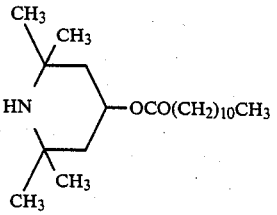

-continued
IV-5
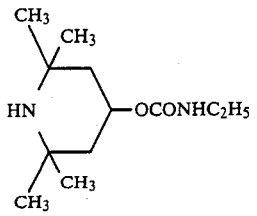
IV-6
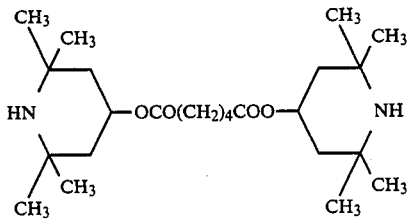
IV-7
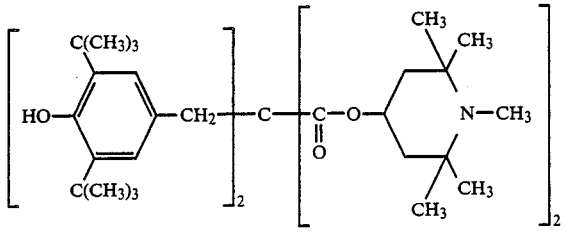
IV-8
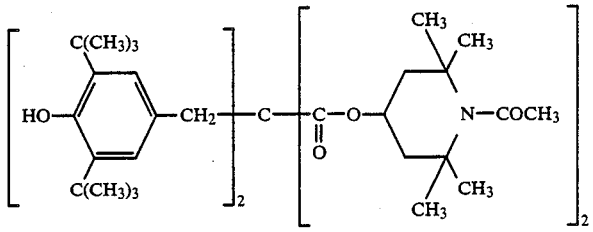
IV-9
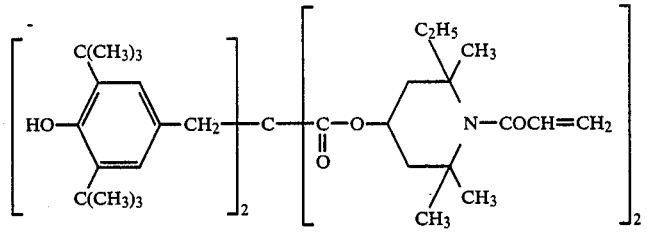
IV-10
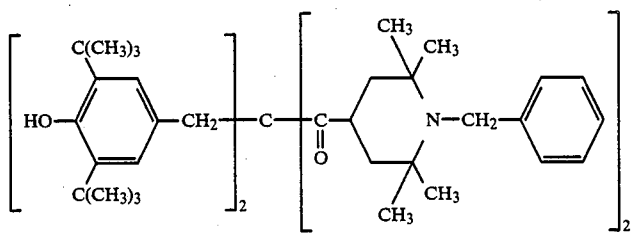
IV-11
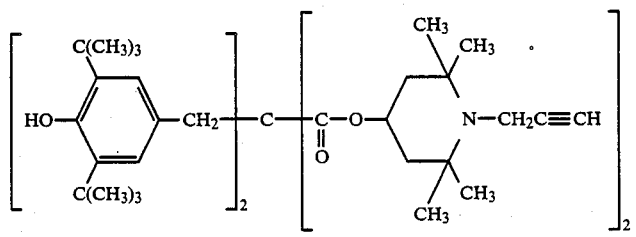

-continued

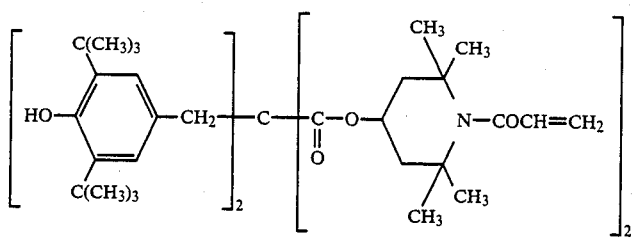

IV-12

Preferably, ten to 200 mole% of the anti-fading agent, expressed by the general formulas [III] or [IV], of the present invention, more specifically five to 100 mole%, is used per 100 mole% of cyan coupler or yellow coupler.

Hydrophobic compounds, such as the previously mentioned cyan, magenta, yellow couplers, and dye-image stabilizers of the present invention, can be added to a silver halide photographic light-sensitive material by means of the solid dispersion method, latex dispersion method, oil-in-water emulsion dispersion method, and others. In the oil-in-water emulsion dispersion method, couplers and other hydrophobic additives are dissolved by using a high-boiling-point organic solvent with a boiling point of higher than 150° C. (preferably one with the dielectric constant of less than 7.0) and, if necessary, together with a low-boiling-point and/or water-soluble organic solvent, whereby the solution is emulsified in a hydrophilic binder, such as a gelatine solution, with the aid of a surface-active agent, then the resultant emulsion is added to the destination hydrophilic colloid layer.

Also, water-soluble compounds can be dissolved in an organic solvent (methanol, ethanol, acetone) that mixes with water, or in an alkali solution prior to addition.

In the silver halide emulsion (hereinafter referred to as the silver halide emulsion of the present invention) employed for the silver halide photographic light-sensitive material of the present invention, any one of silver bromide, silver iodo-bromide, silver iodo-chloride, silver chloro-bromide, a silver chloride, and other silver halides, employed in normal silver halide emulsions, can be used.

A silver halide emulsion of the present invention is chemically sensitized by means of a sulfur sensitization method, a selenium sensitization method, a reducing sensitization method, or a noble metal sensitization method.

A silver halide emulsion of the present invention may be optically sensitized to a desired wavelength range by using sensitizing dyes known in the photographic art.

For the silver halide photographic light-sensitive material of the present invention, an anti-fogging agent, a hardener, a plasticizer, a polymer latex, an ultraviolet absorbent, a formalin scavenger, a mordant, a development accelerator, a development restrainer, a fluorescent whitening agent, a matting agent, a lubricant, an antistatic agent, and a surface active agent may be arbitrarily sued. Any support, found in normal light-sensitive materials, can be used in the light-sensitive material of the present invention. Additionally, a support with thickness of 80 to 150 μm can be used by applying a technic disclosed in Japanese Patent O.P.I. Publication No. 108242/1987.

An image can be formed on a silver halide photographic light-sensitive material of the present invention by using a color developing process well-known in the photographic art.

The color developing agents, which constitute the color developer for the present invention, contain an aminophenol derivative or a p-phenylenediamine derivative used in a wide scope of color photographic processes.

Known developer constituent compounds may be added to the color developer used to process a silver halide photographic light-sensitive material of the present invention, in addition to the primary aromatic amine color developing agents mentioned above.

The pH of color developers is normally greater than 7, and usually 10 to 13.

The color developing temperature is normally higher than 15° C., and usually ranges from 20° C. to 50° C. The temperature should preferably be higher than 30° C. for rapid developing.

A silver halide material of the present invention undergo bleaching and fixing processes after color developing. The material may be simultaneously bleached and fixed.

The material is normally water-rinsed after being fixed. If used in a copier which is later described in preferred examples, the material may be stabilized instead of being water-rinsed.

The above stabilizing solution should preferably contain a chelating agent having the chelate stability constant of higher than 6 relative to iron-ion.

A silver halide photographic light-sensitive material of the present invention provides a dye-image having a very high level of fastness to light because it has layers containing the compound of the present invention. Especially, the present invention improves the fastness to light of magenta dye-image whose fastness to light is generally poor. More specifically, the present invention effectively prevents discoloring or color-fading due to light, and yellowish stains (hereinafter referred to as Y-stain) in the non-colored areas.

EXAMPLE

The present invention is hereinunder described more spoecifically by referring to preferred examples.

EXAMPLE 1

Magenta coupler (MC-1) (6.0 mg/100 cm$^2$) shown below and comparison compound (a) in moles same as the magenta coupler were dissolved in dibutylphthalate (5.0 mg/100 cm$^2$) together with 2,5-di-tert-octylhydroquinone (0.8 mg/100 cm$^2$) and emulsified in gelatine (15.0 mg/100 cm$^2$) solution, whereby the emulsion was mixed with a silver chloro-bromide emulsion and (silver bromide 80 mole%; silver, 3.8 mg/100 cm$^2$). The resultant mixture was then applied to a paper support laminated with polyethylene on both sides. The paper support was then dried to provide sample 1.

Samples 2 through 8 were similarly prepared by independently adding in moles same as the magenta coupler (MC-1) the comparison compound (b), (c) or (d), each being conventionally known as magenta dye-image stabilizer, or the example compounds (1), (51), (53) or (59) instead of compound (a) of sample 1, each being the dye-image stabilizer of the present invention, to the coating solutions for the respective samples mentioned above.

Magenta coupler MC-1

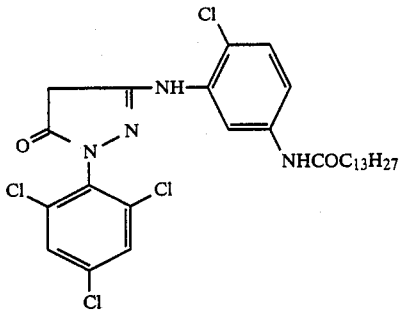

Comparison compound (a)

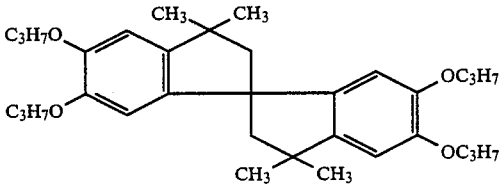

Comparison compound (b)

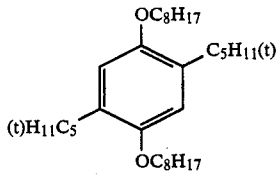

Comparison compound (c)

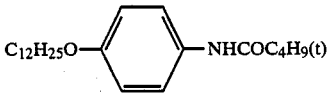

Comparison compound (d)

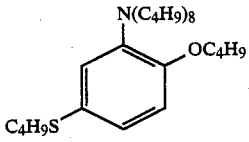

The samples obtained as above were exposed to light through an optical wedge as in the conventional method and then treated in the following process.

| [Treatment] | Temperature | Time |
|---|---|---|
| Color development | 33° | 3 min 30 sec |
| Blea-/fixing | 33° | 1 min 30 sec |
| Water-rinsing | 33° | 3 min |
| Drying | 50–80° | 2 min |

The constituents of each processing solution are as follows:

| | |
|---|---|
| [Color developer] | |
| Benzyl alcohol | 12 ml |
| Diethylene glycol | 10 ml |
| Potassium carbonate | 25 g |
| Sodium bromide | 0.6 g |
| Sodium sulfite Dye-image | 2.0 g |
| Hydroxylamine sulfate | 2.5 g |
| N—ethyl-N—β-methanesulfonamidothyl-3-methyl-4-aminoaniline sulfate | 4.5 g |
| The liter solution was prepared by adding water to the above components, and was adjusted to pH 10.2 with NaOH. | |
| [Blea-fixing solution] | |
| Ammonium thiosulfate | 120 g |
| Sodium metabisulfite | 15 g |
| Sodium sulfite anhydride | 3 g |
| Ferric ammonium EDTA | 65 g |

One liter solution was prepared by adding water to the above components, and was adjusted to pH 6.7 to pH 6.8.

The densities of the samples 1 through 8 treated as above were measured with a densitometer (Model KD-7R of Konishiroku Photo Industry Co., Ltd.) under the following conditions.

Each sample treated as above was irradiated with a xenon fade-meter for 10 days to check the dye image for both light fastness and Y-stains in the non-colored areas. More specifically, the samples were inspected for a density variation of the magenta dye-image (M density variation) before and after the test, by assuming the pre-test density to be 1.0, and for a degree of yellowing in the white areas (Y-stain). Table 1 shows the test results obtained.

TABLE 1

| Sample No. | Dye-image stabilizer | M density change | Y-stain |
|---|---|---|---|
| 1 | Comparison compound (a) | −0.51 | +0.30 |
| 2 | Comparison compound (b) | −0.45 | +0.22 |
| 3 | Comparison compound (c) | −0.42 | +0.28 |
| 4 | Comparison compound (d) | −0.53 | +0.33 |
| *5 | Example compound (1) | −0.16 | +0.06 |
| *6 | Example compound (51) | −0.20 | +0.07 |
| *7 | Example compound (53) | −0.14 | +0.06 |
| *8 | Example compound (59) | −0.16 | +0.05 |

*indicates the samples of the present invention.

Table 1 clearly shows that the samples 5 through 8, provided with a dye-image stabilizer of the present invention, discolor or fade due to light, to a smaller degree, and produce smaller Y-stain than the samples provided a conventional dye-image stabilizer.

EXAMPLE 2

The following coating materials were sequentially layered on a paper support laminated with polyethylene on both sides, thus preparing a multicolor silver halide photographic light-sensitive material, from which the sample 9 was obtained.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide as a yellow coupler was applied at the ratio of 6.8 mg/100 cm²; a blue-sensitive silver chloro-bromide emulsion (containing 85 mole% of silver bromide), at the ratio of 3.2 mg/100 cm² as converted to the amount of silver; dibutylphthalate, at the ratio of 3.5 mg/100 cm²; gelatin, at the ratio of 13.5 mg/100 cm².

Second layer: Intermediate layer 2,5-di-t-oxtylhydroquinone was applied at the ratio of 0.5 mg/100 cm²; dibutylphthalate, at the ratio of 0.5 mg/100 cm²; gelatine, at the ratio of 9.0 mg/100 cm².

Third layer: Green-sensitive silver halide emulsion layer

The previously mentioned magenta coupler (MC-1) was applied to the ratio of 3.5 mg/100 cm²; a green-sensitive silver chloro-bromide emulsion containing 80 mole% of silver bromide, at the ratio of 2.5 mg/cm² as converted to the amount of silver; dibutylphthalate, at the ratio of 3.0 mg/100 cm²; gelatine, the ratio of 12.0 mg/100 cm².

Fourth layer: Intermediate layer 2-(2-hydroxy-3-sec-butyl-5-t-butylphenyl)benzotriazole as an ultraviolet absorbent was applied at the ratio of 0.7 mg/100 cm²; dibutylphthalate, at the ratio of 6.0 mg/100 cm²; 2,5-di-t-octylhydroquinone, at the ratio of 0.5 mg/100 cm²; gelatine, at the ratio of 12.0 mg/100 cm².

Fifth layer: Red-sensitive silver halide emulsion layer

2-[α-(2,4-di-t-pentylphenoxy)butanamide]-4,6-dichloro-5-ethylphenol as a cyan coupler was applied at the ratio of 4.2 mg/100 cm²; a red-sensitive silver chloro-bromide emulsion containing 80 mole% of silver bromide, at the ratio of 3.0 mg/100 cm² as converted to the amount of silver; tricresylphosphate, at the ratio of 3.5 mg/100 cm²; a gelatine, the ratio of 11.5 mg/100 cm².

Sixth layer: Protective layer

Gelatine was applied at the ratio of 8.0 mg/100 cm².

The multi-layered samples 10 through 18 were prepared by adding the compounds of the present invention to the third layer of the previously mentioned sample 9 at the ratios shown in Table 2, and were exposed to light and treated as in Example 1. Then the samples were irradiated with a xenon fade-meter for 15 days to test fastness to light. Table 2 also lists the test results.

TABLE 2

| Sample No. | Dye-image stabilizer | Amount added (mole %/ coupler) | Post-light-exposure residual magenta dye-image (%) |
|---|---|---|---|
| 9 | — | — | 23 |
| *10 | Example compound (1) | 50 | 53 |
| *11 | Example compound (1) | 100 | 63 |
| *12 | Example compound (1) | 150 | 81 |
| *13 | Example compound (11) | 50 | 57 |
| *14 | Example compound (11) | 100 | 68 |
| *15 | Example compound (11) | 150 | 85 |
| *16 | Example compound (53) | 50 | 56 |
| *17 | Example compound (53) | 100 | 66 |
| *18 | Example compound (53) | 150 | 83 |

*indicates the samples of the present invention

Table 2 shows that the compounds of the present invention effectively stabilize magenta dye-images formed from magenta couplers, and that the stabilizing effect increases in proportion to the amount of a compound added.

EXAMPLE 3

The compound (1) of the present invention used in the sample 11 in Example 2 was replaced respectively with example compound (12), (13), (15), (23), (25), (27), (56), (68), (94), (98), (111), (113), (121), (126), or (127) to prepare the similar samples. Each sample was then tested as in Example 2. As a results, each sample showed a very low degree of magenta-dye discoloring, a satisfactory balance in color distribution as one entity of color photographic material, and a satisfactory color reproducibility, thus proving the effect of the compounds of the present invention.

EXAMPLE 4

The magenta coupler (MC-1) (6.0 mg/100 cm²) used in Example 1 were dissolved and in dibutylphthalate (5.0 mg/100 cm²) together with 2,5-di-tert-octylhydroquinone (0.8 mg/100 cm²) and emulsified in gelatine (15.0 mg/100 cm²) solution, whereby the emulsion was mixed with a silver chloro-bromide emulsion (silver bromide, 80 mole%; silver, 3.8 mg/100 cm²). The resultant mixture was then applied to a paper support laminated with polyethylene on both sides. The paper support was then dried to provide the sample 21.

The comparison compound (e) as the dye-image stabilizer was added, in a mole equal to the magenta coupler, to the above mentioned sample 21 to provide the 22.

The image stabilizer (11) of the present invention was added, in a mole equal to the coupler, to the above sample 21 to provide the sample 23.

The samples 24, 27, and 30 were similarly obtained by replacing the magenta coupler of the above mentioned sample 21 respectively with the magenta couplers M-9, 20, and 46 (silver applied, 2.3 mg/100 cm²), expressed by the general formula [M-1].

The comparison compound (e) as the magenta dye-image stabilizer was added, in a mole equal to the coupler, to the above samples 24, 27, and 30 to provide the samples 25, 28, and 31, respectively. Additionally, instead of the comparison compound (e), the example compound (11) of the present invention was added, in a mole equal to the coupler, respectively to the above samples 24, 27, and 30 to provide the samples 26, 29, and 32.

The samples obtained as above were exposed to light through an optical wedge according to a conventional method and then treated in the same process as in Example 1.

The densities of the samples 21 through 31 treated as above were measured with a densitometer (Model KD-7R of Konishiroku Photo Industry Co., Ltd.) under the following conditions.

Each sample treated as above was irradiated with a xenon fade-meter for 14 days to check the dye image for both light fastness and Y-stains in the non-colored areas. Additionally, each sample was left under a high temperature and humidity of 60° C. and 80% RH for 14 days to check the dye-image for moisture resistance and Y-stains in the non-colored areas. Table 3 shows the results obtained.

Fastness to light and moisture resistance of each dye-image were evaluated based on the following criterion.

[Residual dye percentage]

This is the percentage of the residual dye density after the fastness-to-light and moisture-resistance tests, assuming the pre-test density to be 1.0.

[YS]

This value is obtianed by subtracting the pre-test density of Y-stain from the density of Y-stain measured after the fastness-to-light and moisture-resistance tests.

TABLE 3

| Sample No. | Coupler | Dye-image stabilizer | Fastness to light | | Moisture resistance | |
|---|---|---|---|---|---|---|
| | | | Residual dye | YS | Residual dye | YS |
| 21 | MC-1 | — | 35% | 0.60 | 88% | 0.53 |
| 22 | MC-1 | Comparison compound-e | 37 | 0.59 | 89 | 0.56 |
| 23 | MC-1 | Example compound 11 | 47 | 0.53 | 96 | 0.52 |
| 24 | Example coupler 9 | — | 22 | 0.06 | 100 | 0.07 |
| 25 | Example coupler 9 | Comparison compound-e | 60 | 0.11 | 102 | 0.08 |
| 26 | Example coupler 9 | Example compound 11 | 78 | 0.05 | 101 | 0.06 |
| 27 | Example coupler 20 | — | 30 | 0.06 | 102 | 0.06 |
| 28 | Example coupler 20 | Comparison compound-e | 69 | 0.08 | 100 | 0.07 |
| 29 | Example coupler 20 | Example compound 11 | 81 | 0.05 | 98 | 0.06 |
| 30 | Example coupler 46 | — | 15 | 0.08 | 100 | 0.09 |
| 31 | Example coupler 46 | Comparison compound-e | 53 | 0.11 | 97 | 0.10 |
| 32 | Example coupler 46 | Example compound 11 | 11 | 0.06 | 101 | 0.08 |

Table 3 clearly shows that the samples 24, 27, and 30, provided with a coupler expressed by the general formula [M-I], produce a much lower degree of Y-stain in the fastness-to-light test than the sample 21, provided with a conventional tetraequivalent 3-anilino-t-pyrazolone coupler, while readily discolor or fade due to light. The samples 25, 28, and 31 prepared by using both the comparison compound (e) and the coupler expressed by the general formula [M-1], feature improve discoloring or fading of the dye-images, however, fail to reduce Y-stain in the light fastness test.

On the other hand, the table shows that the samples 26, 29, and 32. provided with a couplers and dye-image stabilizer of the present invention, feature only a small degree of discoloring or fading of the dye-images and little Y-stain in the non-colored areas in the resistance tests to light, heat, and moisture.

EXAMPLE 5

The coupler and dye-image stabilizer were combined as shown in Table 4 and applied in the same manner as in Example 1, thus preparing the samples 33 through 48, which were treated in the same manner as in Example 4. Then the light fastness test was conducted on these samples as in Example 4, providing the results shown in Table 4.

TABLE 4

| Sample No. | Coupler | Dye-image stabilizer | Fastness to light | |
|---|---|---|---|---|
| | | | Residual dye | YS |
| 33 | Coupler (2) | 11 | 47 | 0.55 |
| 34 | Coupler (2) | 51 | 45 | 0.52 |

TABLE 4-continued

| Sample No. | Coupler | Dye-image stabilizer | Fastness to light | |
|---|---|---|---|---|
| | | | Residual dye | YS |
| 35 | Coupler (2) | II-6 | 60 | 0.55 |
| 36 | Coupler (2) | II-7 | 61 | 0.61 |
| 37 | Example coupler 18 | II-6 | 54 | 0.13 |
| 38 | Example coupler 18 | II-7 | 56 | 0.14 |
| 39 | Example coupler 29 | II-6 | 62 | 0.16 |
| 40 | Example coupler 29 | II-7 | 63 | 0.15 |
| 41 | Example coupler 18 | 1 | 73 | 0.06 |
| 42 | Example coupler 18 | 11 | 77 | 0.06 |
| 43 | Example coupler 29 | 11 | 76 | 0.05 |
| 44 | Example coupler 29 | 53 | 75 | 0.05 |
| 45 | Example coupler 29 | 59 | 72 | 0.07 |
| 46 | Example coupler 29 | 11, II-6 | 83 | 0.08 |
| 47 | Example coupler 29 | 11, II-7 | 85 | 0.10 |
| 48 | Example coupler 29 | 11, II-10 | 85 | 0.10 |
| 49 | Example coupler 29 | 11, II-15 | 87 | 0.08 |

(In Table 4, the samples 46, 47, and 48 contained the stabilizer 11 and the compound represented by formula [II] at the mole ratio of 2:1, and the number of moles of the dye-image stabilizers identical to that the stabilizer used for other samples.)

Table 4 clearly shows that the combined use of the conventional tetraequivalent 3-anilino-5-pirazolone coupler and dye-image stabilizer of the present invention (samples 33, 34) and the combined use of the coupler and conventionally known magenta dye-image stabilizer (samples 37, 38, 39, 40) scarcely prevent discoloring and Y-stain in the non-colored areas in the light fastness test, and that the combined use of the coupler expressed by the general formula [M-I] and dye-image stabilizer of the present invention produce a significant preventive effect.

The table also shows that the combined use of the coupler expressed by the general formula [M-I], dye-image stabilizer of the present invention represented by general formula [I], and a conventional dye-image stabilizer (samples 46, 47, 48) provide a synergetic effect on the residual dye percentage though a degree of Y-stain in the light fastness test slightly increased.

EXAMPLE 6

The following coating materials were sequentially layered on a paper support laminated with polyethylene on both sides, thus preparing a multicolor silver halide photographic light-sensitive material, from which the sample 29 was obtained.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide as a yellow coupler was applied at the ratio of 6.8 mg/100 $cm^2$; a blue-sensitive silver chloro-bromide emulsion containing 85 mole% of silver bromide, at the ratio of 3.2 mg/100 $cm^2$ as converted to the amount of silver; dibutylphthalate, at the ratio of 3.5 mg/100 $cm^2$; gelatin, at the ratio of 13.5 mg/100 $cm^2$.

Second layer: Intermediate layer 2,5-di-t-oxtylhydroquinone was applied at the ratio of 0.5 mg/100 $cm^2$; dibutylphthalate, at the ratio of 0.5 mg/100 $cm^2$; gelatine, at the ratio of 9.0 mg/100 $cm^2$.

Third layer: Green-sensitive silver halide emulsion layer

The previously mentioned example magenta coupler No. 25 was applied at the ratio of 3.5 mg/100 $cm^2$; a green-sensitive silver chloro-bromide emulsion containing 80 mole% of silver bromide, at the ratio of 2.5 mg/100 $cm^2$ as converted to the amount of silver; dibutylphthalate, at the ratio of 3.0 mg/100 $cm^2$; gelatine, at the ratio of 12.0 mg/100 $cm^2$.

Fourth layer: Intermediate layer 2-(2-hydroxy-3-sec-butyl-5-t-butylphenyl)benzotriazole as an ultraviolet absorbent was applied at the ratio of 2.5 mg/100 $cm^2$; dibutylphthalate, at ratio of 3.0 mg/100 $cm^2$; 2,5-di-t-octylhydroquinone, at the ratio of 0.5 mg/100 $cm^2$; gelatine, at the ratio of 12.0 mg/100 $cm^2$.

Fifth layer: Red-sensitive silver halide emulsion layer

2-[α-(2,4-di-t-pentylphenoxy)butanamide]-4,6-dichloro-5-ethylphenol as a cyan coupler was applied at the ratio of 4.2 mg/100 $cm^2$; a red-sensitive silver chloro-bromide emulsion (containing 80 mole% of silver bromide), at the ratio of 3.0 mg/100 $cm^2$ as converted to the amount of silver; tricresylphosphate, at the ratio of 3.5 mg/100 $cm^2$; gelatine, at the ratio of 11.5 mg/100 $cm^2$.

Sixth layer: Intermediate layer

Same as fourth layer.

Seventh layer: Protective layer

Gelatine was applied at the ratio of 8,0 mg/100 $cm^2$.

The multi-layered samples 50 through 58 were prepared by adding the dye-image stabilizer of the present invention represented by general formula [I] to the third layer of the previously mentioned sample 49 at the ratios shown in Table 5, and were exposed to light and treated as in Example 1. Then the samples were irradiated with a xenon fad-o-meter for 20 days to test fastness to light. Table 5 also lists the test results.

TABLE 5

| Sample No. | Dye-image stabilizer | Amount added (mole %/coupler) | Post-light-exposure residual magenta dye-image (%) |
|---|---|---|---|
| 49 (Comparison compound) | — | — | 21% |
| 50 (The present invention) | 1 | 50 | 49 |
| 51 (The present invention) | 1 | 100 | 65 |
| 52 (The present invention) | 1 | 150 | 80 |
| 53 (The present invention) | 11 | 50 | 56 |
| 54 (The present invention) | 11 | 100 | 70 |
| 55 (The present invention) | 11 | 150 | 85 |
| 56 (The present invention) | 53 | 50 | 52 |
| 57 (The present invention) | 53 | 100 | 67 |
| 58 (The present invention) | 53 | 150 | 83 |

The results show that the dye-image stabilizer of the present invention effectively stabilize magenta dye-images formed from magenta couplers, and that the stabilizing effect increases in proportion to the amount of the stabilizer added. Additionally, the samples of the present invention showed a very low degree of magenta-dye discoloring, a good balance in color distribution as an overall color photographic material comprising yellow and cyan couplers, and a very good color reproducibility.

The example compound 1 of the present invention used in the sample 51 was replaced respectively with (12), (13), (15), (23), (25), (27), (56), (68), (94), (98), (111), (113), (121), (126), and (127) to prepare similar smaples. Each sample was similarly tested and as a result, showed a very low degree of magenta-dye discoloring, a good balance in color distribution as an overall color photographic material, and a good color reproducibility, thus proving the effect of the dye-image stabilizer of the present invention.

EXAMPLE 7

The following coating materials were sequentially layered on a paper support laminated with polyethylene on both sides, thus preparing a color light-sensitive material.

First layer: Blue-sensitive silver halide emulsion layer

A yellow coupler (example compound Y-7) was applied at the ratio of 8 mg/100 $cm^2$; a blue-sensitive silver chlorobromide emulsion containing 20 mole% of silver chloride and 80 mole% of silver bromide, at the ratio of 3 mg/100 $cm^2$ as converted to the amount of silver; a high-boiling-point organic solvent (DNP), at the ratio of 3 mg/100 $cm^2$; gelatin, at the ratio of 16 mg/100 $cm^2$.

Second layer: Intermediate layer

A hydroquinone derivative (HQ-1) was applied at the ratio of 0.45 mg/100 $cm^2$; gelatin, at the ratio of 4 mg/100 $cm^2$.

Third layer: Green-sensitive silver halide emulsion layer

The magenta coupler (MC-3) was applied at the ratio of 4 mg/100 $cm^2$; a green-sensitive silver chloro-bromide emulsion containing 20 mole% of silver chloride and 80 mole% of silver bromide, at the ratio of 4 mg/100 $cm^2$ silver; a high-boiling-point organic solvent (DOP), the ratio of 4 mg/100 $cm^2$; a gelatin, at the ratio of 16 mg/100 $cm^2$.

Fourth layer: Intermediate layer

An ultraviolet absorbent (UV-1) was applied at the ratio of 3 mg/100 $cm^2$; an ultraviolet absorbent (UV-2), at the ratio of 3 mg/100 $cm^2$; DNP, at the ratio of 4 mg/100 $cm^2$; a hydroquinone derivative (HQ-2), at the ratio of 0.45 mg/100 $cm^2$; gelatine, at the ratio of 14 mg/100 $cm^2$.

Fifth layer: Red-sensitive silver halide emulsion layer

A cyan coupler (CC-1) was applied at the ratio of 4 mg/100 $cm^2$; a high-boiling-point organic solvent (DOP), at the ratio of 4 mg/100 $cm^2$; a red-sensitive silver chloro-bromide emulsion containing 20 mole% of silver chloride and 80 mole% of silver bromide, at the ratio of 3 mg/100 $cm^2$ as converted to the amount of silver; gelatine, at the ratio of 14 mg/100 $cm^2$.

Sixth layer: Intermediate layer

An ultraviolet absorbent (UV-3) was applied at the ratio of 4 mg/100 $cm^2$; DNP, at the ratio of 2 mg/100 $cm^2$; gelatine, at the ratio of 6 mg/100 $cm^2$.

Seventh layer: Protective layer

Gelatine was applied at the ratio of 9 mg/100 $cm^2$.

The light-sensitive material obtained was the sample 61. The samples 62, 63, and 64 were prepared by changing the combinations of the magenta couplers in the third layer and cyan couplers in the fifth layer as shown in Table 5. Additionally, the samples 65 through 71 were prepared by adding the same moles of the dye image stabilizing agents of the present invention represented by general formula [I] or comparison image stabilizing agents to the third layer as the mole of magenta couplers.

(Compounds used for sample preparation)

DNP: Dinonylphthalate.

DOP: Dioctylphthalate.

HQ-1

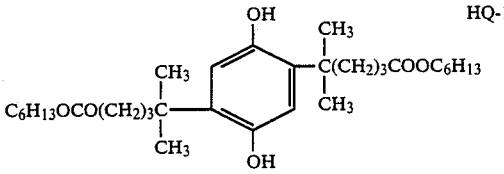

HQ-2

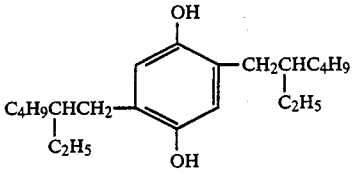

UV-1

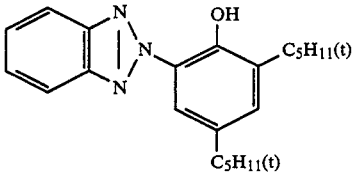

UV-2

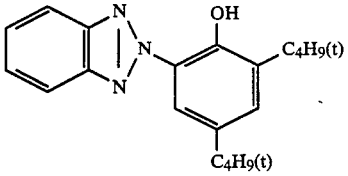

UV-3

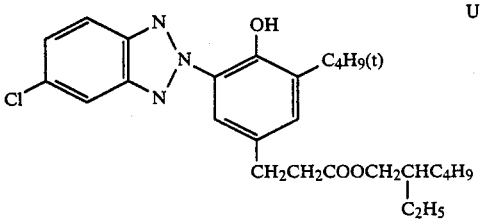

MC-3

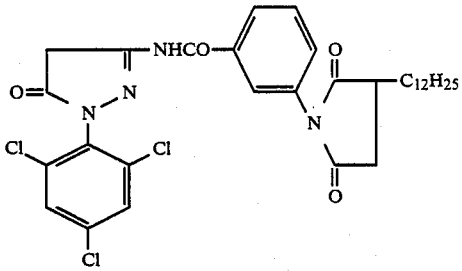

CC-1

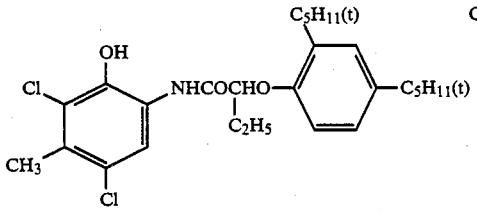

Dye-image stabilizing agent

-continued

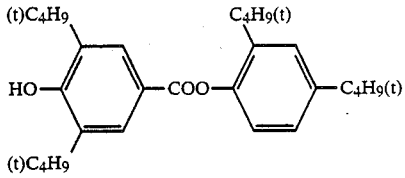

The samples 61 to 71 obtained as above were exposed to light through an optical wedge as in the conventional method and then treated in the following process.

| Treatment | Temperature | Time |
|---|---|---|
| Color development | 32.8° C. | 3 min 30 sec |
| Bleach-/fixing | 32.8° C. | 1 min 30 sec |
| Water-rinsing | 32.8° C. | 3 min 30 sec |

[Constituents of the color developer solution]

| | |
|---|---|
| N—ethyl-N—β-methanesulfonamidethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Sodium sulfite anhydride | 2.0 g |
| Benzyl alcohol | 10.0 ml |
| Polyethylene glycol (Average degree of polymerization: 400) | 3.0 ml |

One liter solution was prepared by adding water to the above components, and was adjusted to pH 10.0 with NaOH.

Each resultant grayed dye-image sample was tested for bright and dark discoloring characteristics, as well as color reproducibility, of dye-images in the following procedure.

[Light discoloring characteristic test]

Each grayed dye-image sample was irradiated to light from 20,000-lux fluorescent lamp for 700 hours and then measured for variation ratios of the B (blue), G (green), R (red) densities, at the area having initial density of 1.0.

[Dark discoloring characteristic test]

Each grayed dye-image sample was left under the constant temperature and humidity of 77 C and 40%RH for two weeks and then measured for change ratios of the B (blue), G (green), R (red) densities, at the area having initial density of 1.0.

[Color Reproducibility]

The negative of a Macbeth color checker, filmed on a Sakura color film SR-V100 with a Sakura color printer 7NII, was printed on each sample mentioned above. The printing conditions were as such that the reference neutral colorimetry chips of the Macbeth color checker were reproduced for the L*, U', V' to be the same in accordance with the indications of the L* U* V* colorimetric system specified in JISZ 8729-1980.

At the same time, the purple colormetry chip of the Macbeth color checker was reproduced, and its L*, U', V' were calculated. Then the differences between the reproduced and the original colorimetry chips were expressed in ΔU' and ΔV'. Additionally, the reproducibility of purple was visually checked. Table 6 shows the test results.

TABLE 6

| Sample No. | Coupler Yellow | Coupler Magenta | Coupler Cyan | Third-layer dye-image stabilizer | Dark discoloring characteristic C | Dark discoloring characteristic M | Dark discoloring characteristic Y | Light discoloring characteristic C | Light discoloring characteristic M | Light discoloring characteristic Y | Purple reproducibility ΔU' | Purple reproducibility ΔV' | Purple reproducibility evaluation |
|---|---|---|---|---|---|---|---|---|---|---|---|---|---|
| 61 | Y-2 | MC-3 | CC-1 | — | 61 | 96 | 94 | 91 | 65 | 85 | +0.015 | +0.035 | Dull purple |
| 62 | Y-2 | M-3 | CC-1 | — | 64 | 97 | 97 | 89 | 21 | 82 | +0.010 | +0.025 | Dull purple |
| 63 | Y-2 | MC-3 | C-1 | — | 98 | 96 | 95 | 84 | 62 | 81 | +0.014 | +0.026 | Dull purple |
| 64 | Y-2 | Example coupler 1 | C-1 | — | 99 | 100 | 98 | 82 | 20 | 81 | +0.006 | +0.014 | Bright purple |
| 65 | Y-2 | Example coupler 1 | C-1 | Comparison-f | 99 | 99 | 98 | 82 | 24 | 81 | +0.007 | +0.015 | Bright purple |
| 66 | Y-2 | Example coupler 1 | C-1 | Comparison-e | 98 | 98 | 98 | 84 | 78 | 83 | −0.006 | +0.020 | Bluer-purple |
| 67 | Y-2 | Example coupler 1 | C-1 | 13 | 99 | 99 | 99 | 85 | 81 | 83 | +0.005 | +0.015 | Bright purple |
| 68 | Y-2 | MC-3 | C-1 | 13 | 98 | 96 | 98 | 86 | 71 | 82 | +0.014 | +0.025 | Dull purple |
| 69 | Y-2 | Example coupler 1 | CC-1 | 13 | 65 | 98 | 98 | 93 | 80 | 85 | +0.010 | +0.025 | Dull purple |
| 70 | Y-2 | Example coupler 1 | C-1 | 15 | 99 | 98 | 98 | 85 | 81 | 84 | +0.005 | +0.014 | Bright purple |
| 71 | Y-2 | Example coupler 1 | C-1 | 23 | 99 | 99 | 98 | 86 | 82 | 84 | +0.005 | +0.014 | Bright purple |

C: Variation ratio of red reflection density of grayed dye-images
M: Variation ratio of green reflection density of grayed dye-images
Y: Variation ratio of blue reflection density of grayed dye-images Table 6 clearly shows that the samples 67, 70, and 71, which used the couplers expressed by the general formulas [Y], [M-I] and [C] together with the dye-image stabilizers of the present invention, maintained a good balance in the dark and bright discoloring characteristics, making the discoloring of the images inconspicuous. Additionally, the photographic images having the faithful and definite reproduction of the colorimetry value of the original purple were obtained.

On the other hand, the sample 65, obtained by using the comparison dye-iamge stabilizer (f), showed a large degree of light discoloring of the magenta dye-image and the greening of the neutral-colored image. The sample 66, obtained by using the comparison dye-image stabilizer e, though allowed less discoloring of the magenta dye-image, turned the purple original image to bluer-purple, providing inferior color reproducibility.

The samples 61, 63, and 68, obtained by using the magenta couplers other than the ones expressed by the general formula [M-I], showed a poor balance in bright discoloring, and the samples 61, 62, and 69, obtained by using the cyan couplers other than the ones expressed by the general formula [C], showed a poor balance in dark discoloring. All these samples showed inferior purple reproducibility.

EXAMPLE 8

Eleven types of samples (72 through 81) were prepared in the same composition as the sample 61 in Example 7 except that the yellow coupler, magenta coupler, cyan coupler, the dye-image stabilizers in the third layer (green-sensitive emulsion layer), and the compounds in the first layer (bue-sensitive emulsion layer) and fifth layer (red-sensitive emulsion layer) were all changed as shown in Table 7.

The samples 72 through 81 were exposed to light through an optical wedge as in the conventional method and then treated in the following process.

| Treatment | Temperature | Time |
|---|---|---|
| Color development | 38° C. | 3 min 30 sec |
| Bleach-/fixing | 38° C. | 1 min 30 sec |
| Stabilizing | 25 to 30° C. | 3 min |
| Drying | 75 to 80° C. | Approx. 2 min |

The constituents of each processing solution are as follows:

[Color developer]

| | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| Hydroxylamine sulfate | 3.0 g |
| 1-hydroxylethylidene-1,1-diphosphonate (60% aqueous solution) | 1.0 g |
| 3-methyl-4-amino-N—ethyl-N—(β-methanesulfonamidethyl) aniline sulfate | 5.5 g |
| Fluorescent whitening agent (4,4-diaminostilbendisulfonic acid derivative) | 1.0 g |
| Hydroxyethylimino diacetic acid | 2.5 g |
| Magnesium chloride hexahydrate | 0.7 g |
| Disodium 1,2-dihydroxybenzene-3,5-disulfonate | 0.2 g |

One liter solution prepared by adding water to the above components, and was adjusted to pH 10.20 with NaOH and $H_2SO_4$.

[Replenisher color developer]

| | |
|---|---|
| Benzyl alcohol | 20.0 ml |
| Ethylene glycol | 20.0 ml |
| Potassium sulfite | 3.0 g |
| Potassium carbonate | 30.0 g |
| Hydroxylamine sulfate | 4.0 g |
| 3-methyl-4-amino-N—ethyl-N—(β-methanesulfonamidethyl) aniline sulfate | 7.5 g |
| Fluorescent whitening agent (4,4-diaminostilbendisulfonic acid derivative) | 1.5 g |
| 1-hydroxyethylidene-1,1-diphosphonate acid (60% aqueous solution) | 1.0 g |
| Hydroxyethylimino diacetate | 2.5 g |
| Magnesium chloride hexahydrate | 0.7 g |
| Disodium 1,2-dihydroxybenzene-3,5-disulfonate | 0.2 g |

One liter solution was prepared by adding water to the above components, and was adjusted to pH 10.70 with NaOH.

[Bleach/fixing solution]

| | |
|---|---|
| Ferric ammonium ethylenediaminetetraacetate dihydrate | 60 g |
| Ethylenediaminetetraacetic acid | 3 g |
| Ammonium thiosulfate (70% aqueous solution) | 100 ml |

-continued

| | |
|---|---|
| Ammonium sulfite (40% aqueous solution) | 27.5 ml |

One liter solution prepared by adding water to the above components, and was adjusted to pH 7.10.

[Stabilizer solution]

| | |
|---|---|
| 5-chloro-2-methyl-4-isothiazoline-3-one | 1.0 g |
| Ethylene glycol | 10.0 g |
| 1-hydroxyethylidene-1,1-diphosphonate | 2.5 g |
| Bismuth chloride | 0.2 g |
| Magnesium chloride | 0.1 g |
| Ammonium hydroxide (28% aqueous solution) | 2.0 g |

One liter solution was prepared by adding water to the above components, and was adjusted to pH 7.0 with $NH_4OH$ or $H_2SO_4$.

Two stabilizer bath tanks were used, and the replenisher stabilizer solution was added to the finishing bath, and the overflow from the finishing bath was fed to the other tank immediately before the finishing bath.

Each grayed dye-image sample treated was tested in the same procedure as in Example 7 for dark and light discoloring characteristics, and for purple reproducibility.

Table 7 shows the test results.

noted that the amount of the gelatine solution applied was 4.4 g/m$^2$.

The nine emulsion layers, described in Japanese Patent Application No. 247801/1985 above, were next built on the paper front (the white polyethylene layer containing titanium dioxide), thus preparing the sample 82, a direct positive color light-sensitive material. The sample contained 0.15 g/m$^2$ of the ultraviolet absorbent [UV-1] used in Example 1 in the second layer (first intermediate layer), 0.2 g/m$^2$ in the forth layer (second intermediate layer), and 0.5 g/m$^2$ in the eighth layer (third intermediate layer). The sample also used the yellow coupler [Y-1], expressed by the general formula [Y], in the seventh layer (blue-sensitive emulsion layer).

Additionally, the samples 83 through 92 were prepared by employing the respective couplers and anti-fading agents in the combinations shown in Table 78.

These samples were treated in the following process.

| Treatment | Temperature | Time |
|---|---|---|
| (1) Immersion in color developer | 38° C. | 8 sec |
| (2) Fogging exposure | — | 10 sec under one lux |
| (3) Color development | 38° C. | 2 min |
| (4) Bleach-fixing | 35° C. | 1 min |
| (5) Stabilizing | 25 to 30° C. | 1 min 30 sec |
| (6) Drying | 75 to 80° C. | 1 min |

TABLE 7

| Sample No. | Coupler Yellow | Coupler Magenta | Coupler Cyan | Magenta layer image stabilizer | Blue sensitive-layer compound | Red sensitive-layer compound | Dark discoloring C | Dark discoloring M | Dark discoloring Y | Light discoloring C | Light discoloring M | Light discoloring Y | Purple reproducibility (Visual evaluation) |
|---|---|---|---|---|---|---|---|---|---|---|---|---|---|
| 72 | Y-2 | MC-1 | CC-1 | — | — | — | 65 | 96 | 95 | 91 | 63 | 84 | Dark purple |
| 73 | Y-2 | M-1 | C-1 | 11 | — | — | 98 | 99 | 98 | 82 | 80 | 82 | Bright purple |
| 74 | Y-2 | M-1 | C-1 | 11 | 56 | 61 | 100 | 99 | 98 | 85 | 82 | 87 | Bright purple |
| 75 | Y-2 | M-1 | C-1 | 11 | V-13 | 61 | 100 | 98 | 98 | 85 | 82 | 88 | Bright purple |
| 76 | Y-2 | M-10 | C-1 | 11 | V-13 | 61 | 100 | 98 | 98 | 85 | 85 | 88 | Bright purple |
| 77 | Y-2 | M-25 | C-1 | 11 | V-13 | 61 | 100 | 98 | 98 | 86 | 87 | 89 | Bright purple |
| 78 | Y-2 | M-25 | C-1 | 11 + II-10 | V-13 | 61 | 100 | 99 | 97 | 86 | 89 | 89 | Bright purple |
| 79 | Y-2 | M-25 | C-1 | 11 + II-20 | V-13 | 61 | 100 | 98 | 98 | 86 | 89 | 90 | Bright purple |
| 80 | Y-2 | M-25 | C-1 + CC-1 | 11 + II-15 | V-13 | 61 | 100 | 98 | 98 | 86 | 89 | 90 | Bright purple |
| 81 | Y-2 | M-25 | C-1 + CC-1 | 11 + II-15 | V-13 | 61 | 97 | 98 | 97 | 90 | 90 | 91 | Bright purple |
| 82 | Y-2 | M-62 | C-1 + CC-1 | 11 + II-15 | V-13 | 61 | 98 | 98 | 97 | 90 | 90 | 91 | Bright purple |

C, M, and Y denote the same as in Table 6. CC-1 denotes the same compound as in Example 7.
The anti-fading agents were applied to the respective emulsion layers in the same moles as the couplers.
The samples 20 to 22 used the same total moles of the cyan couplers comprising C-1 and CC-1 at the mole ratio of 1 to 1 as other samples used C-1.

Table 7 clearly shows that the samples, prepared by using the dye-image stabilizers and couplers expressed by the general formulas [Y], [M-I] or [C], reproduce vivid purple, caused little dark and bright discoloring, and provide a good balance in the discoloring of Y, M, and C.

Additionally, the favorable result of further reduced bright and dark discoloring was obtained by adding the compound III-13 to the blue-sensitive and red-sensitive emulsion layers, and also by adding the compounds II-10, 15, and 20, expressed by the general formula [II], to the green-sensitive emulsion layer.

Additionally, the combined use of C-1 and CC-1 as the cyan coupler (as with the samples 79 through 81), which improved a balance in dark and bright discoloring, is preferable.

EXAMPLE 9

A gelatine solution was applied to the back (the transparent polyethylene layer) of the 110 μm surface-treated polyethylene-laminated paper of stiffness 2.1, and dried as was illustrated in the examples of Japanese Patent O.P.I. Publication No. 108246/1987. It should be Constituents of the processing solution

[Color developer]

| | |
|---|---|
| Benzyl alcohol | 10 ml |
| Ethylene glycol | 15 ml |
| Potassium sulfite | 2.0 g |
| Potassium bromide | 1.5 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N—ethyl-N—(β-methanesulfonamidethyl)aniline sulfate | 5.5 g |
| Fluorescent whitening agent (4,4-diaminostilbendisulfonic acid derivative) | 1.0 g |
| Potassium hydroxide | 2.0 g |

One liter solution was prepared by adding water to the above components, and was adjusted to pH 10.20.

[Bleach-fixing solution]

| | |
|---|---|
| Ferric ammonium ethylenediamineteraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |

One liter solution was prepared by adding water to the above components, and was adjusted to pH 7.0 with pottasium carbonate or glacial acetic acid.

[Stabilizer solution]

| | |
|---|---|
| 5-chloro-2-methyl-4-isothiazoline-3-one | 1.0 g |
| Ethylene glycol | 10.0 g |
| 1-hydroxyethylidene-1,1-diphosphonic acid | 2.5 g |
| Bismuth chloride | 0.2 g |
| Magnesium chloride | 0.1 g |
| Ammonium hydroxide (28% aqueous solution) | 2.0 g |
| Sodium nitrilotriacetate | 1.0 g |

One liter solution prepared by adding water to the above components, and was adjusted to pH 7.0 with ammonium hydroxide or sulfuric acid.

Each of the samples was set in a image forming apparatus shown is FIG. 1 and tested for applicability in a practical operation. FIG. 1 provides a schematic sectional view of an image forming apparatus which accommodates light-sensitive materials of the present invention. The image forming apparatus 1 comprises an image exposure unit 3, a paper feed unit 11, a transfer unit 13, a photographic process unit 24, and a drying unit 30 as seen in the figure.

The image exposure unit 3 comprises a light source 4, a first reflecting mirror 5, a second reflecting mirror 6, a third reflecting mirror 7, a lens 8, a fourth reflecting mirror 9, and a fifth reflecting mirror 10. A light source with even light distribution along its axis is preferred for use as the light source 4, which has a slit made. In this example, a 200 W bar-shaped halogen lamp with a 10 mm-wide slit was used, which has a frosted glass set on the light radiating area to prevent uneven light distribution.

An original (not shown in the figure) set on the transparent original deck glass 2 is slit-exposed to the light source 4, and the reflected light from the original, or the light image is sequentially radiated through the exposure opening 23 via the first reflecting mirror 5, second reflecting mirror 6, third reflecting mirror 7, lens 8, fourth reflecting mirror 9, and fifth reflecting mirror 10 onto the light-sensitive material 12 which was travelling in synchronization with the scanning of the light source 4. The light image corresponding to the original is in this way radiated onto the light-sensitive material. The first reflecting mirror 5, second reflecting mirror 6, and third reflecting mirror 7 also travels in synchronization with the scanning of the light source 4. The lens 8, fourth reflecting mirror 9, and fifth reflecting mirror 10 are stationary during exposure, but, when magnification ratio is adjusted, move to the corresponding preset positions before exposure, thus changing the optical distance.

The light-sensitive material 12, employed in this example, is formed into a roll, and housed in the dark chamber 12'. After being drawn out from the dark chamber 12', the light-sensitive material is transferred through inside the transfer unit 13 by pairs of press-rotating rollers 14/14' through 21/21'. The rolled light-sensitive material 12 is cut into sheets of the desired size by the cutter 22 installed along the transfer course. After being cut, the light-sensitive material is transferred in the form of independent sheet. Cutters for use as the cutter 22 include a cutter which sequentially cuts the light-sensitive material 12 while moving across the material, and a cutter which cuts the material all at once by descending with its edge parallel to the face of the material 12, and are not particularly specified as long as they can cut the light-sensitive material 12. It is needless to say that sheets of light-sensitive materials instead of rolls are usable as the light-sensitive material 12. The use of sheet materials eliminate the need for the cutter 22 described above. After being cut into sheets as above, the light-sensitive material 12 travels in synchronization with the scanning of the light source 4 while being exposed to the light image reflected from the original at the exposure opening 23 as described above. Additionally, in this example, the light-sensitive material 12 was cut before exposure, though, it may be cut after exposure.

After being exposed, the light-sensitive material 12 in transferred to the photographic process unit 24.

The photographic process unit 24 subjects the exposed light-sensitive material 12 to the photographic processing, thus developing a positive image corresponding to the original. The photographic processing unit 24, employed in this example, comprises the four processing tanks, that is, the developing tank 25, bleach-fixing tank 26, and stabilizing tanks 27 and 28. The stabilizing tanks 27 and 28 are a double tank incorporating counter flow design. The light source 29 provides fogging exposure during developing the internal latent image light-sensitive material which was used as the light-sensitive material 12. The light-sensitive material 12 is processed in a prescribed time in each processing tank of the photographic process unit 24, and transferred to the drying unit 30. After being dried, the material is ejected from the image forming device.

Numeral 31 in the figure indicates a waste tank, and 32 a replenisher solution tank.

The image exposure unit 3, employed in this example, consists of five mirrors, but this unit may be constructed of three or one mirror for a compact design.

After being loaded into the magazine 12', the samples were transferred, exposed, and developed in the same process with the same treating solutions as described earlier by means of the above image forming device.

The double tank counter flow system was employed for stabilizing.

A Macbeth color checker was set on the original deck glass of the previously mentioned copier, and the Macbeth neutral color and other colorimetry chips were copies and reproduced on the respective light-sensitive materials mentioned above.

The samples thus obtained were tested for dark and bright discoloring characteristics in the grayed areas, and for purple reproducibility of the reproduced purple colorimetry chip of the Macbeth color checker in the same procedure as in Example 2. Table 8 shows the test results.

TABLE 8

| Sample No. | Coupler Yellow | Coupler Magenta | Coupler Cyan | Magenta layer dye-image stabilizer | Dark discoloring characteristic C | Dark discoloring characteristic M | Dark discoloring characteristic Y | Light discoloring characteristic C | Light discoloring characteristic M | Light discoloring characteristic Y | Purple reproducibility (Visual evaluation) |
|---|---|---|---|---|---|---|---|---|---|---|---|
| 82 | Y-2 | MC-1 | CC-1 | — | 64 | 95 | 96 | 93 | 62 | 82 | Dull purple |
| 83 | Y-2 | M-1 | CC-1 | — | 66 | 99 | 98 | 92 | 25 | 81 | Dull purple |
| 84 | Y-2 | MC-1 | C-1 | — | 97 | 96 | 97 | 85 | 61 | 81 | Dull purple |
| 85 | Y-2 | M-1 | C-1 | — | 99 | 99 | 98 | 84 | 25 | 82 | Bright purple |
| 86 | Y-2 | M-1 | C-1 | 11 | 99 | 100 | 98 | 85 | 80 | 83 | Bright purple |
| 87 | Y-2 | MC-1 | C-1 | 11 | 98 | 96 | 98 | 85 | 79 | 84 | Dull purple |
| 88 | Y-2 | M-1 | C-1 + CC-2 | 11 | 98 | 99 | 97 | 89 | 80 | 85 | Bright purple |
| 89 | Y-2 | M-1 | C-1 + CC-1 | 11 | 97 | 98 | 98 | 86 | 81 | 84 | Bright purple |
| 90 | Y-2 | M-1 | C-1 + CC-1 | 11 + II-10 | 97 | 99 | 98 | 88 | 86 | 85 | Bright purple |
| 91 | Y-2 | M-1 | C-1 + CC-1 | 11 + II-20 | 98 | 99 | 99 | 88 | 88 | 85 | Bright purple |
| 92 | Y-2 | M-1 | C-1 + CC-1 | 11 + II-15 | 97 | 99 | 98 | 89 | 86 | 85 | Bright purple |

Types and amount of CC-1, II-10, II-15 and II-20 are identical with those in example 8.

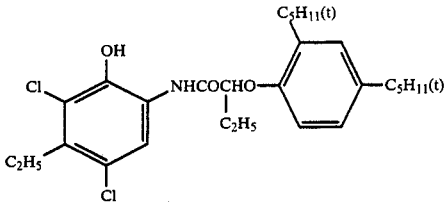

Table 8 clearly shows that when copied with the previously mentioned copier, the samples, prepared by using the dye-image stabilizers and couplers expressed by the general formulas [Y], [M-I], and [C], provided bright purple reproduction, and copied images of well-balanced dark and light discoloring.

What is claimed is:

1. A silver halide photographic light-sensitive material comprising a support having thereon photographic structural layers comprising at least one silver halide emulsion layer, wherein at least one of said photographic structural layers contains a compound represented by the following general formula [I]

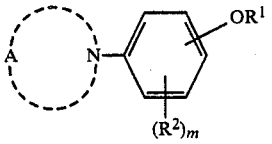

General Formula [I]

wherein R′ represents an alkyl group, a cycloalkyl group, an alkenyl group, an aryl group, a heterocyclic group, an acryl group, a bridged hydrocarbon group, an alkylsulfonyl group or an arylsulfonyl group each allowed to have a substituent; $R^2$ represents a group capable of bonding with benzene ring as a substituent and is allowed to form a ring by bonding to —OR′; m represents an integer of 0 to 4, provided that, when m is 2 or more, $R^2$s may be the same with or different from each other and are allowed to form a ring by bonding to each other; and

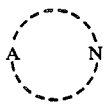

is a ring taken from the class consisting of pyrrolidone, piperidine, piperazine, morpholine, and pyridine.

2. The silver halide photographic light-sensitive material of claim 1, wherein said silver halide emulsion layer contains a magenta coupler represented by the following general formula [M-I];

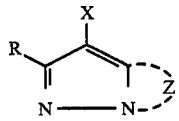

General formula [M-I]

wherein R represents a substituent; Z represents a group of non-metallic atoms necessary for forming a nitrogen-containing heterocyclic ring; and X represents a hydrogen atom or a group capable of being splitted off upon reaction with the oxidized product of a color developing agent.

3. The silver halide photographic light-sensitive material of claim 2, wherein said substituent represented by R is an alkyl group, an aryl group, an anilino group, an acylamino group, a sulfonamido group, an alkylthio group, an arylthio group, an alkenyl group or cycloalkyl group each allowed to have a substituent.

4. The silver halide photographic light-sensitive material of claim 2, wherein said compound represented by the general formula [I] is contained in said silver halide emulsion layer containing said magenta coupler represented by general formula [M-I].

5. The silver halide photographic light-sensitive material of claim 2, wherein the amount of said compound represented by the general formula [I] contained in said silver halide emulsion layer is with in the range of from 0.1 mol to 4 mol per mol of said magenta coupler represented by the general formula [M-I], which coupler is contained in said silver halide emulsion layer.

6. The silver halide photographic light-sensitive material of claim 2, wherein said compound represented by the general formula [I] is contained in one of said photographic structural layers adjacent said silver halide emulsion layer containing said magenta coupler represented by the general formula [M-I].

7. The silver halide photographic light-sensitive material of claim 4, wherein said silver halide emulsion layer containing said magenta coupler represented by the general formula [M-I] and said compound represented by the general formula [I] contains a compound represented by the following general formula [II]:

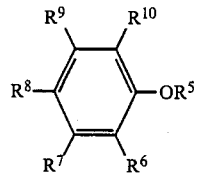

General formula [II]

wherein $R^5$ represents a hydrogen atom, an alkyl group, an alkenyl group, an aryl group or a heterocyclic group; $R^6$, $R^7$, $R^9$ and $R^{10}$ represent an hydrogen atom, or a halogen atom, a hydroxy group, an alkyl group, an alkenyl group, an aryl group, an alkoxy group or acylamino group each allowed to have a substituent, respectively; $R^8$ represents an alkyl group, a hydroxy group, an aryl group or an alkoxy group each allowed to have a substituent, respectively; $R^5$ and $R^6$ are allowed to form a five- or six-membered ring by bonding to each other, provided that $R^8$ is a hydroxy group or an alkoxy group.

8. The silver halide photographic light-sensitive material of claim 2, wherein said photographic structural layers include a silver halide emulsion layer containing a cyan coupler represented by the following general formula [C] and a silver halide emulsion layer containing a yellow coupler represented by the following general formula [Y]:

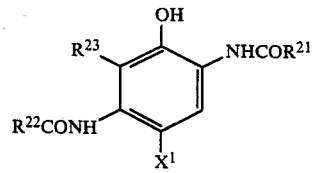

General formula [C]

wherein $R^{21}$ and $R^{22}$ represent an alkyl group, a cycloalkyl group, an alkenyl group, an aryl group or an heterocyclic goup each allowed to have a substituent, respectively; $R^{23}$ represents a hydrogen atom, a halogen atom, or an alkyl group or an alkoxy group each allowed to have a substituent, $R^{22}$ and $R^{23}$ are allowed to form a ring by coupling to each other; and X represents a hydrogen atom or a group capable of being splitted off upon reaction with the oxidized product of a color developing agent,

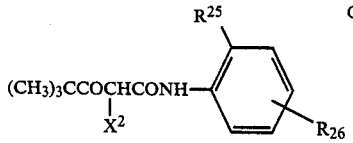

General formula [Y]

wherein $R^{25}$ represents a hydrogen atom, a halogen atom or an alkoxy goup allowed to have a substituent; $R^{26}$ represents an —$NHCOR^{27}$ group, an —$NHSO_2R^{27}$ group, a —$COOR^{27}$ or an —$SO_2NR^{27}R^{28}$ group, in which $R^{27}$ and $R^{28}$ represent an alkyl group each allowed to have a substituent, respectively; and $X^2$ represents a hydrogen atom or a group capable of being splitted of upon reaction with the oxidized product of a color developing agent.

9. The silver halide photographic light-sensitive material of claim 8, wherein at least one of said silver halide emulsion layer containing said cyan coupler represented by the general formula [C] and said silver halide emulsion layer containing said yellow coupler represented by the general formula [Y] contains at least one compound represented by the following formula [III] or [IV]:

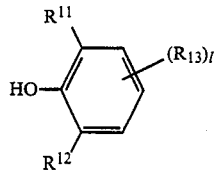

General formula [III]

wherein $R^{11}$ and $R^{12}$ represent an alkyl group allowed to have a substituent, respectively; $R^{13}$ represents an alkyl group allowed to have a substituent, an —$NHR^{14}$ group, an —$SR^{14}$ or a —$COOR^{15}$ group, in which $R^{14}$ represents an univalent organic group and $R^{15}$ represents a hydrogen atom or an univalent organic group; l represents an integer of 0 to 3,

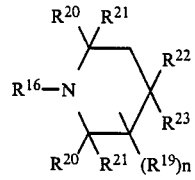

General formula [IV]

wherein $R^{16}$ represents a hydrogen atom, a hydroxy group, an oxi-radical, an —$SOR^{17}$ group, a —$COR^{16}$ group, or an alkyl group, an alkenyl group or an alkinyl group each allowed to have a substituent, in which $R^{17}$ represents an alkyl group or an aryl group each allowed to have a substituent and $R^{18}$ represents a hydrogen atom or an univalent organic group; $R^{19}$, $R^{20}$ and $R^{21}$ represent an alkyl group allowed to have a substituent, respectively; $R^{22}$ and $R^{23}$ represent a hydrogen atom or a —$OCOR^{24}$ group, respectively, in which $R^{24}$ represent an univalent organic group, and $R^{22}$ and $R^{23}$ allowed to couple each other to form a heterocyclic ring; and n represents an integer of 0 to 4.

10. The silver halide photographic light-sensitive material of claim 8, wherein said photographic structural layers include a silver halide emulsion layer containing said cyan coupler represented by the general formula [C] and a silver halide emulsion layer containing said yellow coupler represented by the general formula [Y].

11. The silver halide photographic light-aenaitive material of claim 9, wherein at least one of said silver halide emulsion layer containing said cyan coupler represented by the general formula [C] and said silver halide emulsion containing said yellow coupler represented by the general formula [Y] contains said compound represented by the general formula [III] or [IV].

* * * * *